US006715858B1

(12) United States Patent
Ogawa et al.

(10) Patent No.: US 6,715,858 B1
(45) Date of Patent: Apr. 6, 2004

(54) IMAGE-FORMING DEVICE

(75) Inventors: Katsutoshi Ogawa, Hirakata (JP); Masahiro Aizawa, Takatsuki (JP); Akira Kumon, Katano (JP); Akira Fukano, Ikoma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/979,225

(22) PCT Filed: May 19, 2000

(86) PCT No.: PCT/JP00/03254

§ 371 (c)(1),
(2), (4) Date: May 10, 2002

(87) PCT Pub. No.: WO00/69637

PCT Pub. Date: Nov. 23, 2000

(30) Foreign Application Priority Data

May 19, 1999 (JP) ..... 11-138226
Jun. 15, 1999 (JP) ..... 11-167710

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294

(56) References Cited

U.S. PATENT DOCUMENTS 3,689,935 A 9/1972 Pressman et al.
5,374,949 A 12/1994 Wada et al.
5,812,160 A 9/1998 Wada et al.

FOREIGN PATENT DOCUMENTS

| | | |
|---|---|---|
| JP | 44-26333 | 11/1969 |
| JP | 60-020747 | 2/1985 |
| JP | 63-272560 | 11/1988 |
| JP | 04-166348 | 6/1992 |
| JP | 05-193182 | 8/1993 |
| JP | 06-297753 | 10/1994 |
| JP | 07-164669 | 6/1995 |
| JP | 08-281999 | 10/1996 |
| JP | 9-500842 | 1/1997 |
| JP | 09-234905 | 9/1997 |
| JP | 2769389 | 4/1998 |
| JP | 10-100780 | 4/1998 |
| JP | 10-286988 | 10/1998 |
| JP | 11-202222 | 1/1999 |
| JP | 11-179952 | 7/1999 |
| WO | WO95/24675 | 9/1995 |

*Primary Examiner*—Raquel Yvette Gordon
(74) *Attorney, Agent, or Firm*—Jordan and Hamburg LLP

(57) ABSTRACT

An image forming device includes a developer carrier (1) for carrying a charged developer (2), and a developer passing controller (3) for applying a voltage corresponding to an image. signal to a plurality of control electrodes (10) to control the passing of said developer (2), the developer passing controller having a plurality of developer passing holes (4) through which the developer (2) passes and said control electrodes being arranged to surround the surroundings of the developer passing holes. The width (W1) of a control electrode row (5) in the longitudinal direction where the control electrodes (10) are arranged is wider than the width (W2) of an image forming area, and both ends (B1, B2) of the control electrode row (5) in the longitudinal direction are arranged outside the width (W2) of an image forming area.

25 Claims, 18 Drawing Sheets

IMAGE-FORMING DEVICE

TECHNICAL FIELD

The present invention relates to an image forming device applied to a copying machine, a facsimile, a printer and the like. Specifically, the invention relates to an image forming device for forming an image in a way that the travel of developer from a developer carrier to a backside electrode is controlled by a developer passing controller based on an image signal and developer is attached on an image receiving member located between the developer passing controller and the backside electrode.

BACKGROUND ART

Recently, there is a strong demand for a copying machine or a printer capable of handing a mass of documents including color documents, accompanied with the improvement in the performance of a personal computer and the progress of network technology. However, it is still under development and expected to realize an image forming device which is capable of outputting black and white or color documents with sufficient and high quality and has a high processing speed.

As one of such technologies, the image forming technology called as "toner jet (registered trademark)" where toner flies onto the image receiving member such as recording paper or an intermediate image carrying belt under the effect of electric field is known.

Such image forming devices are disclosed in Japanese Examined Patent Publication No. 44-26333, U.S. Pat. No. 3,689,935 (corresponding to Japanese Examined Patent Publication No. 60-20747) and Japanese Patent National Publication No. 9-500842. As one of examples, a prior art shown in Japanese Patent Application No. 10-100780 is explained in detail with reference to FIG. 17.

In FIG. 17, a grounded toner carrier 131 holds charged toner and conveys it. A regulating blade 132 manages toner layers from a single to triple on the toner carrier 131 and also charges toner. A supplying roller 133 supplies toner to the toner carrier 131 and charges toner. A toner passing controller 134 has a toner passing hole 135 formed therein and a control electrode 136 around the hole. A voltage corresponding to an image signal is applied to the control electrode 136 from a control power source 137. Reference numeral 138 is a backside electrode and reference numeral 139 is a backside electrode power source. Reference numeral 140 denotes an image receiving member such as recording paper conveyed on the backside electrode 138.

In this structure, a uniform toner layer is formed on the toner carrier 131 with the regulating blade 132 by operating the supplying roller 133 and the toner carrier 131, and conveyed. Under this state, a voltage is applied to the backside electrode 138 and the image receiving member 140 is moved. Then, the control power source 137 such as a driver IC applies a voltage corresponding to an image signal to the control electrode 136 in synchronization with the movement of the image receiving member 140. Thereby, toner on the toner carrier 131 flies onto the image receiving member 140 while passing through the toner passing hole 135 corresponding to the image signal and attaches to it. Thus, a desired image is formed on the image receiving member 140.

Here, in order to form a fine image such as 600 dpi (600 dots per inch) on the entire surface of the image receiving member 140, the toner passing holes 135 have to be arranged in such a pitch on the toner passing controller 134. However, it is difficult to arrange them in a single row. As shown in FIG. 18, the toner passing holes 135 and the control electrodes 136 are arranged in a plurality of rows (eight rows in the shown example). The toner passing hole 135 and the control electrode 136 are shaped in a circle. Connecting electrodes connecting with the respective control electrodes 136 are extended to the moving direction of the toner carrier 131 and on both sides thereof to avoid mutual interference and connected to lead terminals of driver ICs outputting control voltage, respectively.

FIG. 17 shows an example that the image receiving member 140 is made of recording paper and others and an image is formed directly on this means. However, there are variations of thickness of recording paper, change of its characteristics with humidity variation and deformation occurs easily during conveyance. In case of a color printer, it is difficult to synchronize timing of forming an image for every color because of variation in conveyance of recording paper. This causes poor image quality. In order to avoid it, as shown in Japanese Patent Application No. 10-100780, it is preferable that an intermediate image holding belt is used as the image receiving member 140 and an image formed on this belt is transferred to recording paper collectively.

Referring to FIG. 19, an endless image holding belt 143 as the image receiving member 140 is made of a film in which conductive filler is dispersed in a resin with its resistance of $10^{10}$ Ωcm and is rolled up between a pair of rollers 144*a* and 144*b*. A pickup roller 145 supplies a piece of recording paper 146 from a paper feed tray. A timing roller 147 synchronizes position of an image with the supplied recording paper 146. A transfer roller 148 transfers a toner image formed on the image holding belt 143 to the recording paper 146, sandwiches the image holding belt 143 with the roller 144*a*, and presses the belt toward the roller 144*a*. At the same time, the transfer roller receives transfer voltage. A fixation device 149 fixes the toner image on the recording paper 146 by heating and pressing the recording paper 146 where a toner image has been transferred.

The above image forming device, however, has the following problems in case when the widths of the control electrode rows and the toner passing hole rows in the longitudinal direction, where the toner passing hole and the control electrode around it are installed, are equal to or less than the maximum printing width of the image receiving member in a direction perpendicular to the moving direction of the image receiving member.

First, an image density is decreased or irregularity of the image density is yielded in the area at the right and left ends of a formed image.

Next, when the toner passing controller is shifted in the direction perpendicular to the moving direction of the image receiving member, the area where the control electrode opposed to the image receiving member does not exist, namely, the area where an image cannot be formed is generated.

In addition, when the toner passing controller is not located in parallel to the orthogonal line perpendicular to the moving direction of the image receiving member, an image forming area W20 is limited to W20=W10 cos θ where the angle between the orthogonal line and the control electrode row is θ and the width of the control electrode row in the longitudinal direction is W10.

The first problem will be explained hereafter with reference to FIG. 16A and FIG. 16B. FIG. 16A and FIG. 16B are diagrams showing the vicinity of the end portion of the developer passing controller. FIG. 16A is a cross section of the vicinity of the end portion of the developer passing controller. FIG. 16B is an upper view of the vicinity of the end portion of the developer passing controller. In FIGS. 16A and 16B, reference numeral 1 is the developer carrier, 2 is the developer layer formed on the developer carrier 1 and 3 is the developer passing controller. Further, reference numerals 4*a*, 4*b*, and 4*c* are developer passing holes and 10*a*, 10*b*, and 10*c* are control electrodes installed around developer passing holes 4*a*, 4*b*, and 4*c*, respectively. The control electrode 10*c* is the control electrode at the outermost end of the control electrode rows. Further, an arrow in FIG. 16A shows the electric power lines formed between the control electrodes 10*a*–10*c* and the developer carrier 1 when the developer carrier 1 is grounded and a positive voltage is applied to the control electrodes 10*a*–10*c*.

The reason why an image density decreases at the right and left ends of a formed image is explained with reference to FIGS. 16A and 16B. Namely, since the control electrode 10*b* is adjacent to the control electrodes 10*a* and 10*c*, the electric power lines between the control electrode row and the developer carrier 1 in the area A in FIG. 16A becomes dense. On the other hand, means generating the electric field does not exist at the right of the control electrode 10*c* located at the outermost end. Hence, the electric power lines in the area B in FIG. 16A is expanded, and its density becomes sparse. Namely, the electric field strength in the area B becomes small compared with the area A. Therefore, the amount of the developer peeled off from the developer carrier 1 by the control electrode 10*c* at the outermost end and is a little. An image density printed by the control electrode 10*c* is lower compared with that by the control electrode 10*b*.

Further, when the toner passing controller is detachable from the image forming device, a predetermined clearance is needed between the toner passing controller and the image forming device in order to make it ease to detach them. Therefore, the above second and third problems become serious since it is difficult to keep the toner passing controller at a regular position. Further, in case of a color image forming device having a plurality of toner passing controller, each color is not superimposed to a regular position, namely, so called color blur is caused, if the above 2nd and 3rd problems are not solved.

Further, in the above-mentioned image forming device, the distance from the toner passing controller 134 to the toner carrier 131 or the backside electrode 138 is from several to hundreds of microns. Hence, electrical field is concentrated easily to a conductor or the convex portion of the toner passing hole 135 since the toner passing controller 134 includes the minute control electrode 136, a conductor, and the toner passing hole 135. Similarly, the electric field is also concentrated easily at the ends of the backside electrode 138 and the toner carrier 131. Therefore, when the voltage from many hundreds to several thousand volts is applied to the backside electrode 138 and the control electrode 136, the electric discharge phenomenon occurs among the toner passing controller 134, the toner carrier 131, and the backside electrode 138. Hence, there is a problem of destroying each means and disarranging a toner image formed on the image receiving member 140.

Further, in the conventional constitution, a conductor group is installed in a base layer of the toner passing controller 134 at regulated intervals. Hence, ruggedness is seen at arraying cycle of the conductor group at the surface of the toner passing controller 134 at the side of the toner carrier 131. In this constitution, when the toner carrier 131 is rotated for a long time while contacting the toner passing controller 134, a convex portion of the toner passing controller 134 is worn out. Hence, a conductor portion of the toner passing controller 134 is finally exposed. Accordingly, there is a problem that the electric discharge phenomenon easily occurs between the convex portion of the toner passing controller 134 and the toner carrier 131.

Further, when a maintaining member maintaining the distance between the toner carrier 131 and the toner passing controller 134 is installed, the toner carrier 131 contacts the maintaining member and rotates for a long time. In this case, there is a problem where a toner layer formed on the toner carrier 131 is disarranged by the maintaining member or the maintaining member is deformed. Accordingly, the distance between the toner carrier 131 and the toner passing controller 134 is changed. Hence, there is a problem that irregularity occurs in an image density.

In addition, as disclosed in Japanese Patent No. 2769389, toner, attached to the toner passing controller 134, is drawn and removed by using an airflow generating member to prevent toner clogging at the toner passing hole 135. In this case, not only toner, attached to the toner passing controller 134, however also the toner passing controller 134 itself is drawn to the side of the airflow generating member with airflow. There is also a problem where load of the vacuum drawing power is charged to only one part of the toner passing controller 134 when airflow is locally formed, and the toner passing controller 134 is deformed accordingly.

In view of the above-mentioned problems of the prior art, the object of the present invention is to provide an image forming device capable of forming an image properly formed to the right and left ends and without color blur for a color image.

Further, in view of the above-mentioned problems of the prior art, the object of the present invention is to provide an image forming device which can stabilize image quality.

DISCLOSURE OF THE INVENTION

An image forming device of the present invention comprises: a developer carrier for carrying a charged developer; a developer passing controller having a plurality of developer passing holes through which the developer passes, applying a voltage corresponding to an image signal to a plurality of control electrodes arranged to surround the surroundings of the developer passing holes to control the passing of developer; an image receiving member for receiving the developer passed through; and a backside electrode installed at the back side of the image receiving member, drawing the developer, wherein the width of a control electrode row in a longitudinal direction, where the control electrodes are arranged, is wider than the width of an image forming area in a direction perpendicular to a moving direction of the image receiving member, and both ends of the control electrode row in the longitudinal direction are arranged outside the width of the image forming area. Accordingly, it becomes a constitution to have excess control electrodes outside an image forming area.

Accordingly, the area where the electric power lines becomes sparse is located outside of an image forming area and the uniform electric field strength is formed within the image forming area. Therefore, a preferable quality image without irregularity of the image density between the center part and the right and left ends of a formed image is obtained, since developer is moved to the developer passing controller within a uniform electric field strength area.

Further, a voltage is applied to an outside part from the width of an image forming area of the control electrode row so as to obstruct the passing of developer through the developer passing hole during time when image formation is operated. Hence, this prevents the passing of developer from the developer passing hole, arranged outside of the width of an image forming area, to the side where the backside electrode is arranged.

Further, the developer passing hole is formed only in the portion arranged inside the maximum width of an image forming area of the control electrode row. Hence, this overcomes a problem completely where the developer is spilt to the backside electrode from the developer passing hole, arranged outside the maximum width of the image forming area.

Further, a correction member for correcting an address of the control electrode, where the image signal is supplied, based on the relative position of the developer passing controller to the image receiving member, is provided. Hence, the image forming area width formed on the image receiving member is adjusted to the regular width through correcting the address by the correction member in order to supply image signal to the control electrode in the part corresponding to the area of the image forming area width even if it is not arranged at a regular position since the developer passing controller has the control electrode row of which width is wider than the image forming area width.

Further, the correction member comprises: a detection member detecting the relative position of the developer passing controller to the image receiving member; a calculating member calculating correcting data based on the detection signal sent from the detection member; and a storage member for storing the correcting data obtained from the calculating member. Hence, a series of every correcting operation such as detection, calculation and storage is omitted since the relative position of the developer passing controller, detected by the detection member, is stored in the storage member as correcting data.

Further, the above correction is implemented by installing the detection member and the calculating member in the image forming device only when it is necessary, if the detection member and the calculating member, provided in the correction member, are detachable from the image forming device.

Further, the above-mentioned correction member is installed on the image forming device where a plurality of the developer carriers and the developer passing controller are installed. Hence, a high quality image without color blur is output since developer for each color is given to a correct image forming position by the correction member, even if the developer passing controller for each color is not arranged at a regular position.

Further, the developer passing controller is detachable from a main body of the image forming device and the correcting operation by the correction member is executed every time when the developer passing controller is installed in the main body of the image forming device. Hence, the change of the printing width and color blur etc. are suppressed by the correction member even if the developer passing controller is repeatedly detached from the main body of the image forming device. Therefore, the performance of maintenance is improved since a clearance between the developer passing controller and its installation position is sufficiently secured.

Further, another image forming device of the present invention comprises: a developer carrier for carrying a charged developer; a developer passing controller having a plurality of developer passing holes through which the developer passes, applying a voltage corresponding to an image signal to a plurality of control electrodes arranged to surround the surroundings of the developer passing holes, to control the passing of developer; a voltage supplying member for supplying a voltage corresponding to the image signal; an image receiving member for receiving the developer passed through; and a backside electrode, installed at the back side of the image receiving member, drawing the developer, wherein an external electrode, installed outside at both ends of the control electrode row in a longitudinal direction where the control electrodes are arranged in a direction perpendicular to a moving direction of the image receiving member, receives a desired voltage. Hence, the decrease of density and the irregularity of density in the right and left ends in an image forming area are restrained since the uniform electric field strength is formed in the entire width of the control electrode row as well as the control electrode arranged outside of the image forming area width. At the same time, manufacturing the developer passing controller becomes easy since the manufacturing area of ring like electrodes and the developer passing holes is decreased.

Further, the external electrode may be extended in parallel to a lead line connecting the control electrode with the voltage supplying member. A developer layer formed on the developer carrier approaches the lead line while it is transported to the position opposed to the developer passing hole. The electric field is formed between the lead line and the developer carrier since an image signal to the control electrode is applied to the lead line. The developer layer supplied to the position of the end of the developer passing hole row passes the same electric field as the center part of the developer passing hole row since the external electrode is extended in parallel to the lead line. Hence, the developer layer is transported to the developer passing hole row without omitting the developer layer at the end of the developer passing hole row while transporting it.

Further, when a voltage of the same polarity as that of developer is applied to the external electrode, the adhesion of the developer having the forward polarity on the external electrode and accumulation thereon are prevented since developer having the forward polarity on the developer carrier receives the electric repulsion power from the external electrode.

Further, by superimposing an alternating current voltage to the external electrode, the adhesion and accumulation of developer of not only the positive polarity however also the inverse polarity on the external electrode is prevented. At the same time, even when the developer is attached on the external electrode, the ac electric field formed between the developer carrier and the external electrode comes to act as an electric field where the developer on the external electrode is collected to the side where the developer carrier is arranged.

Further, a voltage applied to the control electrode, which obstructs the passing of developer, may be applied to the external electrode during time of the operation of the image formation. In this way the electric field strength formed between the developer passing controller and the developer carrier is uniformed across the width of the developer passing hole row in the longitudinal direction without newly installing a power source for the external electrode.

Further, yet another image forming device of the present invention comprises: a developer carrier for carrying a charged developer; a developer passing controller having a plurality of developer passing holes through which the developer passes, applying a voltage corresponding to an image signal to a plurality of control electrodes arranged to surround the surroundings of the developer passing holes to control the passing of developer; an image receiving member for receiving the developer passed through; and a backside electrode, installed at the back side of the image receiving member, drawing the developer, wherein a width of an electrode row, arranged in an area which is adjacent to the developer carrier in the developer passing controller, is narrower than a width of a developer layer held on the developer carrier, viewed from a direction perpendicular to the moving direction of the image receiving member, and both ends of the electrode row are arranged inside both ends of the developer layer.

Further, yet another image forming device of the present invention comprises: a developer carrier for carrying a charged developer; a developer passing controller having a plurality of developer passing holes through which the developer passes, applying a voltage corresponding to an image signal to a plurality of control electrodes arranged to surround the surroundings of the developer passing holes to control the passing of developer; a maintaining member contacting a developer layer on the developer carrier and the developer passing controller to maintain a distance from the developer layer on the developer carrier to the developer passing controller constantly; an image receiving member receiving the developer passed through; and a backside electrode, installed at the back side of the image receiving member, drawing the developer, wherein a width of an electrode row, arranged in an area which is adjacent to the developer carrier in the developer passing controller, is narrower than a width of the maintaining member, viewed from a direction perpendicular to the moving direction of the image receiving member, and both ends of the electrode row are arranged inside both ends of said maintaining member.

Further, the width of the image receiving member is wider than the width of the backside electrode, viewed from the direction perpendicular to the moving direction of the image receiving member, and both ends of the image receiving member are arranged outside both ends of the backside electrode.

Further, the width of the developer passing controller is wider than the width of the developer carrier or the width of the backside electrode, viewed from the direction perpendicular to the moving direction of the image receiving member, and both ends of the developer passing controller are arranged outside both ends of the developer carrier or both ends of the backside electrode.

Further, the width of the developer layer is narrower than the width of the maintaining member, viewed from the direction perpendicular to the moving direction of the image receiving member, and both ends of the developer layer are arranged inside both ends of the maintaining member.

Further, the width of the developer passing controller is wider than the width of the maintaining member, viewed from the direction perpendicular to the moving direction of the image receiving member, and both ends of the developer passing controller are arranged outside both ends of the maintaining member.

Further, the width of the developer carrier is wider than the width of the maintaining member, viewed from the direction perpendicular to the moving direction of the image receiving member, and both ends of the developer carrier are arranged outside both ends of the maintaining member.

Further, yet another image forming device of the present invention comprises: a developer carrier for carrying a charged developer; a developer passing controller having a plurality of developer passing holes through which the developer passes, applying a voltage corresponding to an image signal to a plurality of control electrodes arranged to surround the surroundings of the developer passing holes to control the passing of developer; an image receiving member for receiving the developer passed through; a backside electrode having an opening, installed at the back side of the image receiving member, drawing the developer with electromagnetic force; and an airflow generating member drawing the developer adhered to the developer passing controller with airflow, wherein a width of the opening is wider than a width of an electrode row located in a region which is adjacent to the developer carrier in the developer passing controller, viewed from a direction perpendicular to the moving direction of the image receiving member, and both ends of the opening are arranged outside both ends of the electrode row.

Further, yet another image forming device of the present invention comprises: a developer carrier for carrying a charged developer; a developer passing controller having a plurality of developer passing holes through which the developer passes, applying a voltage corresponding to an image signal to a plurality of control electrodes arranged to surround the surroundings of the developer passing holes to control the passing of developer; an image receiving member for receiving the developer passed through, the image receiving member having a second opening; a backside electrode having a first opening, installed at the back side of the image receiving member, drawing the developer with electromagnetic force; and an if airflow generating member drawing the developer adhered to the developer passing controller to the first opening through the second opening with airflow, wherein a width of the first opening is wider than a width of the second opening, viewed from a direction perpendicular to the moving direction of said image receiving member, and both ends of said first opening are arranged outside both ends of said second opening.

Further, it is desirable that the above-mentioned electrode row has the control electrode row where the control electrodes are arranged and the external electrode, arranged outside both ends of the control electrode row in the longitudinal direction, receiving a desired voltage. Further, it is desirable that an insulation layer is installed in the area where both ends of the backside electrode are located in the back on the surface of the image receiving member opposed to the developer passing controller. Further, it is desirable that the maintaining member is made of an insulating material.

BRIEF DESCRIPTION OF THE DRAWINGS

FIG. 2A is a plan view of the installation of the electrode and FIG. 2B is a plan view of the installation of the deflection electrode;

FIG. 15A is an upper view and FIG. 15B is a side view thereof;

FIG. 16A is a cross section of the vicinity of ends and FIG. 16B is an upper plan view of the vicinity of ends;

BEST MODE FOR CARRYING OUT THE INVENTION

A whole constitution of an image forming device according to each embodiment of the present invention will be explained with reference to FIG. 1–FIG. 4 hereinafter.

Figure 1:
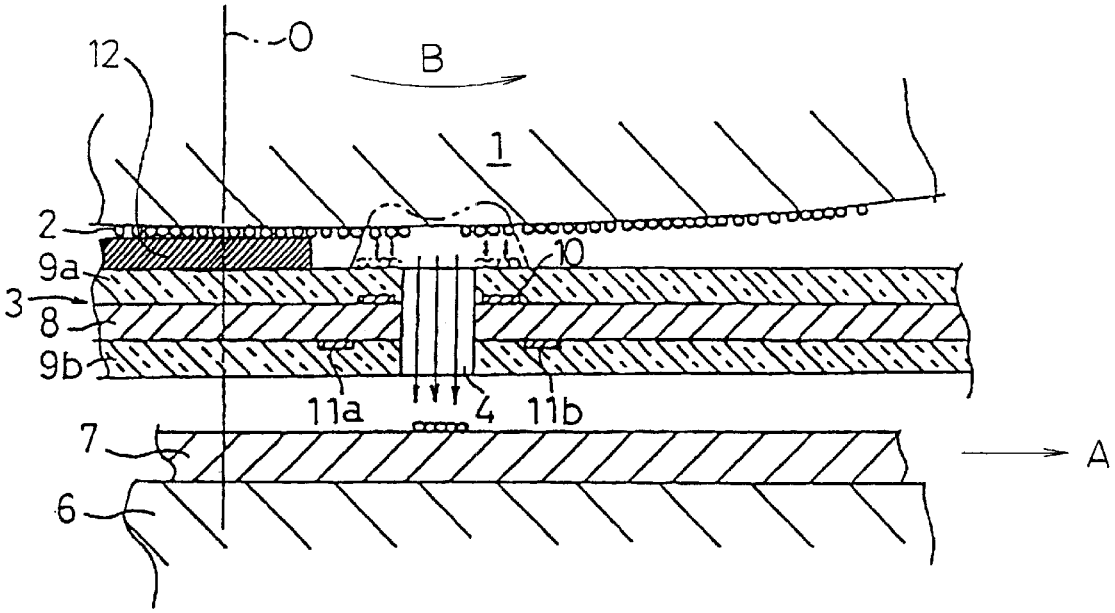
FIG. 1 illustrates a front view of the cross section of major part of an image forming device according to a first, second and third embodiments of the present invention.

In FIG. 1, reference numeral 1 is a toner carrier carrying charged developer, toner 2, for instance, which comprises a grounded rotatable sleeve and rotates in the direction of the arrow B. The toner 2 charged with the negative polarity is absorbed in the state of a thin layer of one to three layers on the surface of the toner carrier 1. Reference numeral 3 is a toner passing controller composed of a flexible printed circuit board. Reference numeral 4 is a toner passing hole where toner 2 on the toner carrier 1 passes through. The row of the toner passing holes 4 is formed at the position which is located about 300–500 $\mu$m away to the downstream of the moving direction of the toner carrier 1 with respect to the center line O which is fallen down from the axis of the toner carrier 1 vertically to the toner passing controller 3.

Reference numeral 12 is a spacer installed to the upstream of the rotation direction of the toner carrier 1 from the toner passing hole 4. The spacer 12 is installed on the toner passing controller 3. Distance Lk between the toner carrier 1 and the toner passing controller 3 is maintained constantly with the value of about 5–50 microns since the spacer contacts with toner layer 2 on the toner carrier 1. Material of the spacer 12 is a metallic film such as stainless steel and aluminum or a plastic film such as PET, PTFE, and polyimide.

Reference numeral 6 is a backside electrode installed to be opposed to the toner carrier 1 through the toner passing controller 3 in between them. Reference numeral 7 is an image receiving member such as recording paper, an image holding belt, or an image holding drum which is transported on a regulated route between the backside electrode 6 and the toner passing controller 3.

As shown in FIG. 1, the toner passing controller 3 is composed of three-layered polyimide resin film which comprises a base layer 8 of 50 $\mu$m thickness and upper and lower protection layers 9*a* and 9*b* of 10–30 $\mu$m thickness adhered to both surfaces of the layer 8 with an adhesive layer of 10–15 $\mu$m. Of course, material and size of each film and the number of composition layers are not limited to the above example and are designed freely.

The control electrode 10 is installed on the upper surface of the base layer 8 to surround surroundings of the toner passing hole 4. A pair of deflection electrodes 11*a* and 11*b* is installed on the lower surface of the base layer 8 to surround the toner passing hole 4 from both sides. These electrodes 10, 11*a*, and 11*b* are made of Cu film, of which thickness is 8–20 $\mu$m, formed with specific patterns on the base layer 8.

Figure 2A:
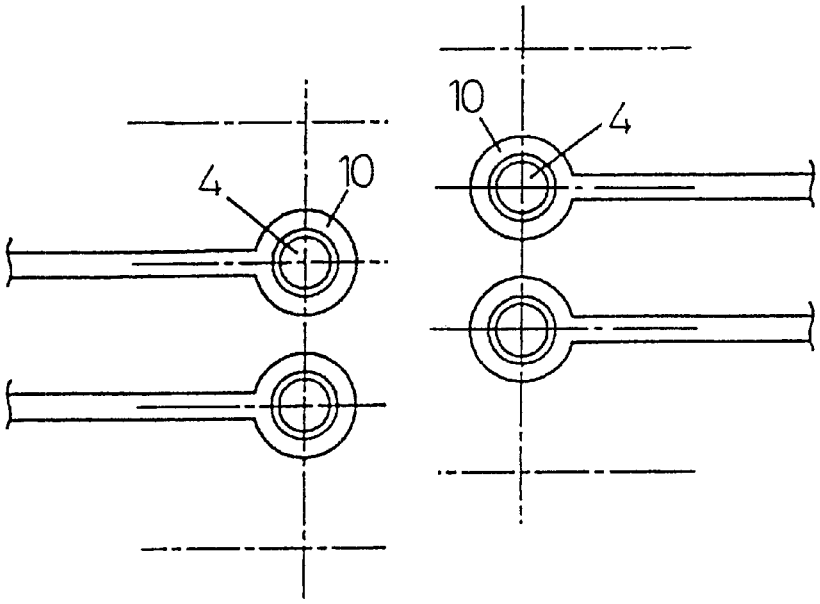
FIG. 2A and FIG. 2B illustrate the installation of each electrode according to the embodiments.

The shape of each toner passing hole 4 is a circle as shown in FIG. 2A, however may be oval or elliptical. The diameter of the toner passing hole 4 is set to be about 70 to 120 $\mu$m. Further, the surface roughness R of the inner wall of the toner passing hole 4 is equal to or below the average particle diameter of the outside additive for toner 2 which is not less than 0.1 $\mu$m and not more than 0.5 $\mu$m. It is possible to manufacture a hole having the surface roughness R by processing a hole with an excimer laser or a press processing. Further, after a hole is made by a YAG laser or a $CO_2$ laser, it is possible to postprocess the hole such as etching and others.

Figure 2B:
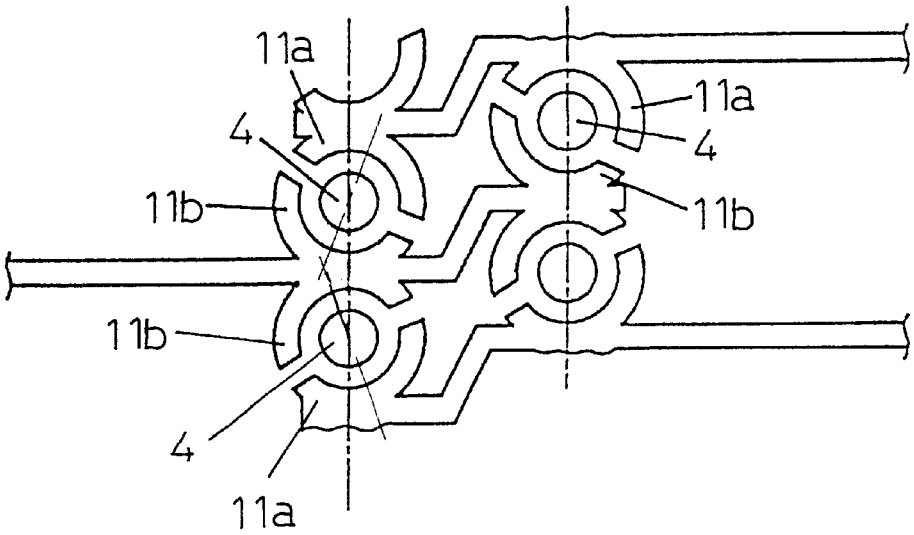

It is desirable that the shape of the control electrode around the toner passing hole 4 is a plane shape corresponding to the toner passing hole 4 as is shown in FIG. 2A. Further, the deflection electrodes 11*a* and 11*b* are commonly used by the toner passing holes 4 which are adjacent each other as shown in FIG. 2B.

Figure 3:
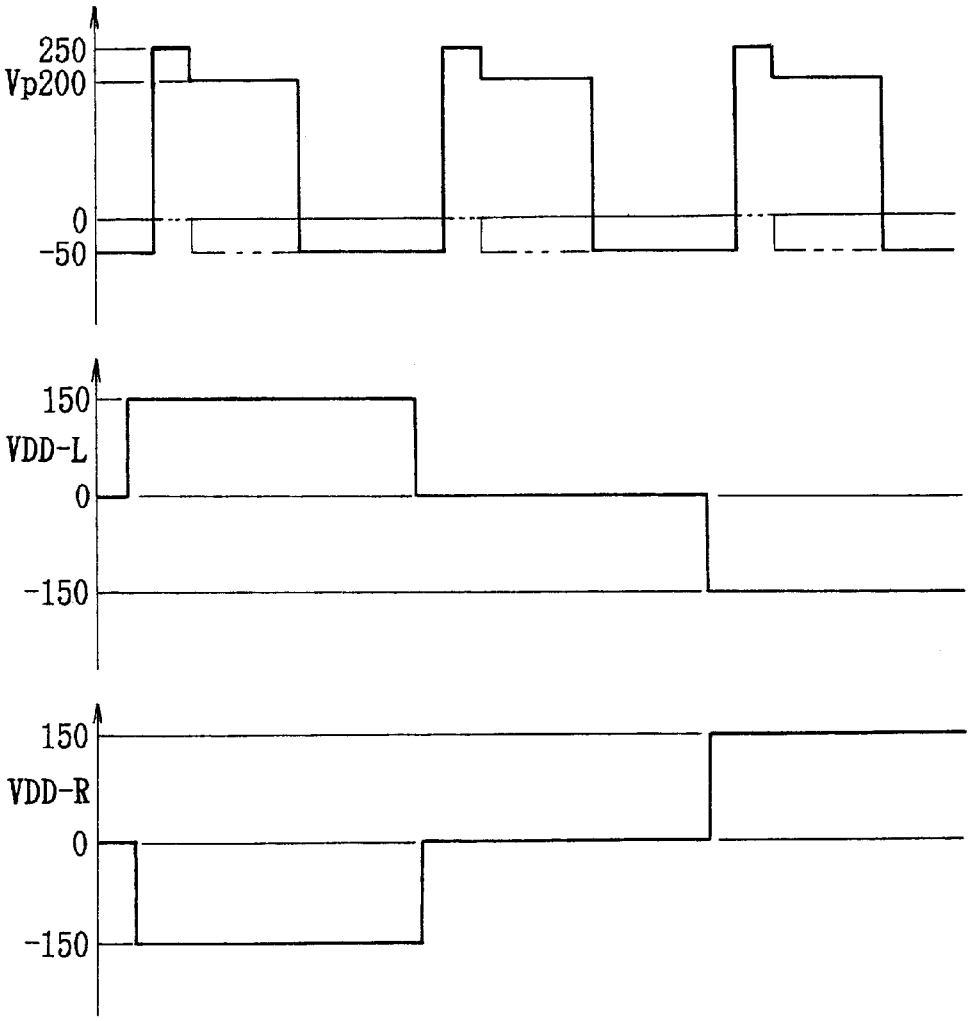
FIG. 3 is a timing chart of an applied voltage to the electrode and the deflection electrode according to the embodiments.

In the above-mentioned constitution, a voltage Vp applied to each control electrode 10 is switched among −50V, 200V and 250V, for instance, and voltages VDD-L and VDD-R applied to the deflection electrodes 11*a* and 11*b* are switched among 50V, 0V and −150V, for instance, with the timing shown in FIG. 3. A voltage applied to the backside electrode 6 is 1000V for instance.

Figures 4A, 4B, 4C:
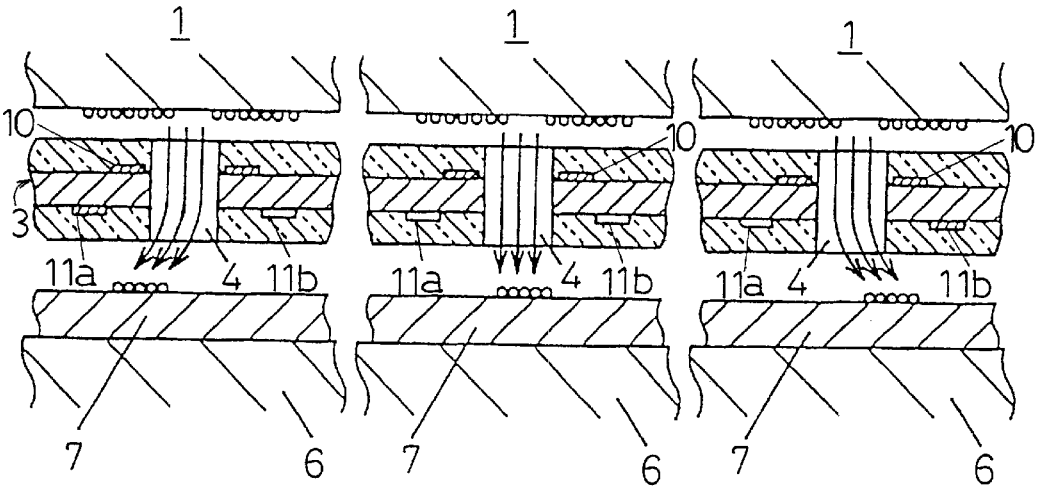
FIG. 4A–FIG. 4C illustrate side views of the cross section showing three operating states in an arbitrary toner passing hole according to the embodiments.

In FIG. 3, the electric field by the backside electrode 6 does not affect toner 2 absorbed by the toner carrier 1 under the condition that the deflection electrodes 11*a* and 11*b* are 0V and the control electrode 10 is −50V. Under this state, first, +150V is applied to the left deflection electrode 11*a* and −150V is applied to the right deflection electrode 11*b* so that the negative-charged toner 2 is deflected to the left direction. Then, a voltage of 250V is applied to the control electrode 10 so that toner 2, which has absorbed in the toner carrier 1, is peeled off. Further, a voltage of 200V is applied to it afterwards. Hence, the toner 2 passes through the toner passing hole 4, and flies with deflecting to the left side, as shown in FIG. 4A. Then, the toner is placed in the position displaced to the left with 40 μm for instance, from the position which is opposed to the toner passing hole 4 on the image receiving member 7. Next, a voltage applied to the right and left deflection electrodes 11*a* and 11*b* is 0V. Under this state, the toner 2 is placed in the position opposed to the toner passing hole 4 on the image receiving member 7 as shown in FIG. 4B by applying a voltage to the control electrode 10 same as the above case. Next, −150V is applied to the left deflection electrode 11*a* and +150V is applied to the right deflection electrode 11*b* so that the negative-charged toner 2 is deflected to the right direction. Under this state the same voltage as the above-described case is applied to the control electrode 10 so that toner is placed in the position displaced to the right with 40 μm from the position which is opposed to the toner passing hole 4 on the image receiving member 7. Hence, the toner 2 is attached to three points of the right and left and the center by one piece of the toner passing hole 4 by means where each of voltages applied to the control electrode 10, the deflection electrodes 11*a* and 11*b* is switched subsequently.

Here, even when the passing of the toner 2 through the toner passing hole 4 is prevented, a voltage applied to the control electrode 10 becomes to be 0V for a moment from −50V, shown as the two-point chain line. Hence, under this state, among the toner 2, the toner 2, specified as being charged with the inverse polarity (positive polarity) and accumulated on the surface of the toner passing controller 3, moves to return to the side of the toner 2 which is charged with the negative polarity and absorbed in the toner carrier 1. Further, the toner 2 charged with negative polarity is accumulated around the toner passing hole 4 by means where the toner 2 with the inverse polarity, accumulated on the upper portion of the control electrode 10, comes to be a nucleus. Hence, this prevents the cause of clogging in the toner passing hole 4.

Major parts of each embodiment in an image forming device of the above-mentioned whole constitution will be explained in detail thereafter.

First Embodiment

Figure 5:
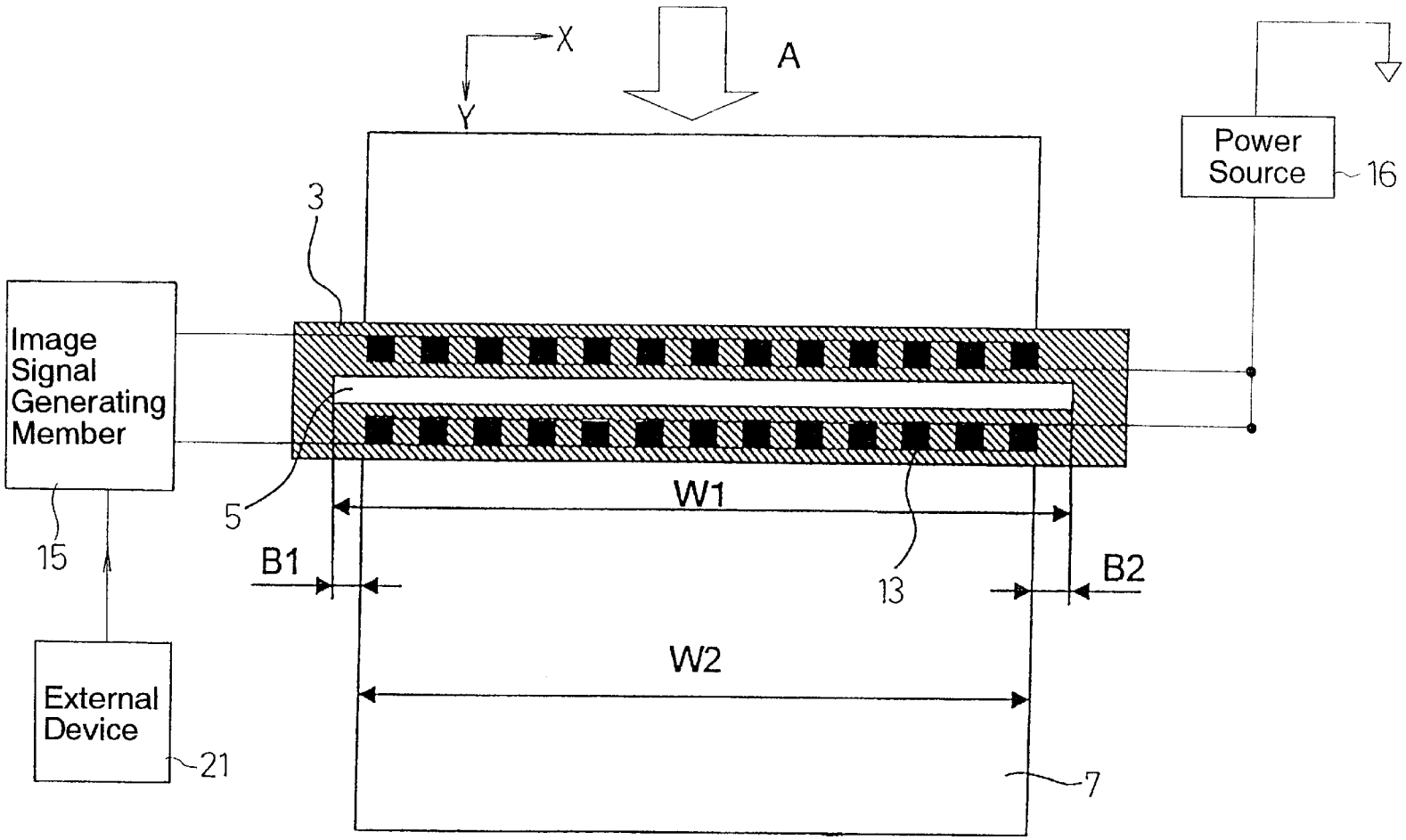
FIG. 5 illustrates an upper view of the toner passing controller of the image forming device seen from the toner carrier according to the first embodiment of the present invention.

FIG. 5 is an upper view when the image receiving member 7 is seen from the toner carrier 1 through the toner passing controller 3 in the first embodiment. A direction perpendicular to the transported direction of the image receiving member 7 is defined as the direction X and a transported direction of the image receiving paper is defined as the direction Y, hereafter.

In FIG. 5, reference numeral 3 is toner passing controller, and reference numeral 5 is a control electrode row where the control electrode 10 shown in FIG. 2A is arranged in the direction X. Reference numeral 7 is an image receiving member.

Here, when widths in the direction X of the control electrode row 5 and the image receiving member 7 are W1 and W2, respectively, the following equation is satisfied.

$$W1>W2$$

The arrangement of the constitution is completed so that the control electrode row 5 may also exist in outside areas of the image receiving member 7, shown as B1 and B2 in FIG. 5.

Further, reference numeral 13 is a driving IC connected with each control electrode 10. Reference numeral 21 is an external device such as a computer, where image data are generated. An image signal generating member 15 receives image data from the external device 21 and supplies an image signal to each drive IC 13 based on the received data. A power source 16 is to supply a desired voltage to the control electrode 10, and connected with each drive IC 13. Driver IC 13 selects the control electrode 10 where a voltage is supplied from the power source 16 corresponding to an image signal from the image signal generating member 15.

Next, operation is explained. First, the image receiving member 7 is transported in the direction of an arrow A in FIG. 5. The image signal to select ON or OFF of each control electrode 10 is supplied from the image signal generating member 15 to each driver IC 13, at the same time when the image receiving member 7 is transported to the position opposing to the toner passing controller 3. A desired voltage shown in FIG. 3 according to the above-mentioned image signal is selectively supplied from the power source 16 to the control electrode 10. Accordingly, toner 2 carried on the toner carrier 1 (not shown in FIG. 5) passes through the toner passing hole 4 provided inside of each control electrode 10 and is deposited on the image receiving member 7. Further, the variation voltage with same polarity as that of the toner 2, shown as two-point chain line in FIG. 3, is supplied to the control electrode 10 in the area of B1 and B2 in FIG. 5. The image receiving member 7 receives the toner 2, having passed through the toner passing hole 4, as moving in the direction of the arrow A. A toner image is finally formed on the image receiving member 7.

In the above-mentioned operation, a voltage is applied to the control electrode 10 in the areas of B1 and B2. Hence, the uniform electric field is formed in the direction X between the toner carrier 1 and the control electrode row 5 without making the electric power lines sparse at the control electrode 10 corresponding to the right and left ends of the image receiving member 7. Accordingly, a high quality toner image is formed on the image receiving member 7, without the irregularity of an image density at the center part and the ends of the right and left of the image receiving member 7. Further, the toner 2 on the toner carrier 1 never moves to the side of the toner passing controller 3 since a voltage of the same polarity as that of the toner 2 is applied to the control electrode 10 located outside the area of the image receiving member 7, namely, the area of B1 and B2. Accordingly, the toner adhesion to the right and left ends of the image receiving member and the toner dirt in the image forming device are prevented since the toner 2 is not exhaled from the toner passing hole 4 at the outside area of the image receiving member 7.

Here, it is preferable to have only the control electrode 10 in the area of B1 and B2 of the toner passing controller 3 without installing the toner passing hole 4. Hence, exhaling the toner 2 at the outside area of the image receiving member 7 is completely prevented.

Further, as explained in the embodiment, it is desirable that the variation voltage shown as a two-point chain line in FIG. 3 is applied to the electrode installed in the area of B1 and B2 of the toner passing controller 3. For instance, when a direct current at fixed voltage is applied to the electrode in the area of B1 and B2, the inverse polarity toner, coexisting in the toner layer on the toner carrier 1, adheres to the electrode of area B1 and B2. Hence, toner is accumulated in the electrode at the area of B1 and B2 by repeating the image forming operation for a long time. Accordingly, a problem of varying the distance between the toner carrier 1 and toner passing controller 3 occurs.

Second Embodiment

In the first embodiment, the ring like control electrode 10 was installed in the area of B1 and B2 of toner passing controller 3. However, a similar effect is achieved even if a plate like or a lead line like external electrode is installed instead. In such case, it becomes easy to manufacture the toner passing controller 3 since the area where a complex, minute processing is needed like the ring shape decreases.

Figure 6:
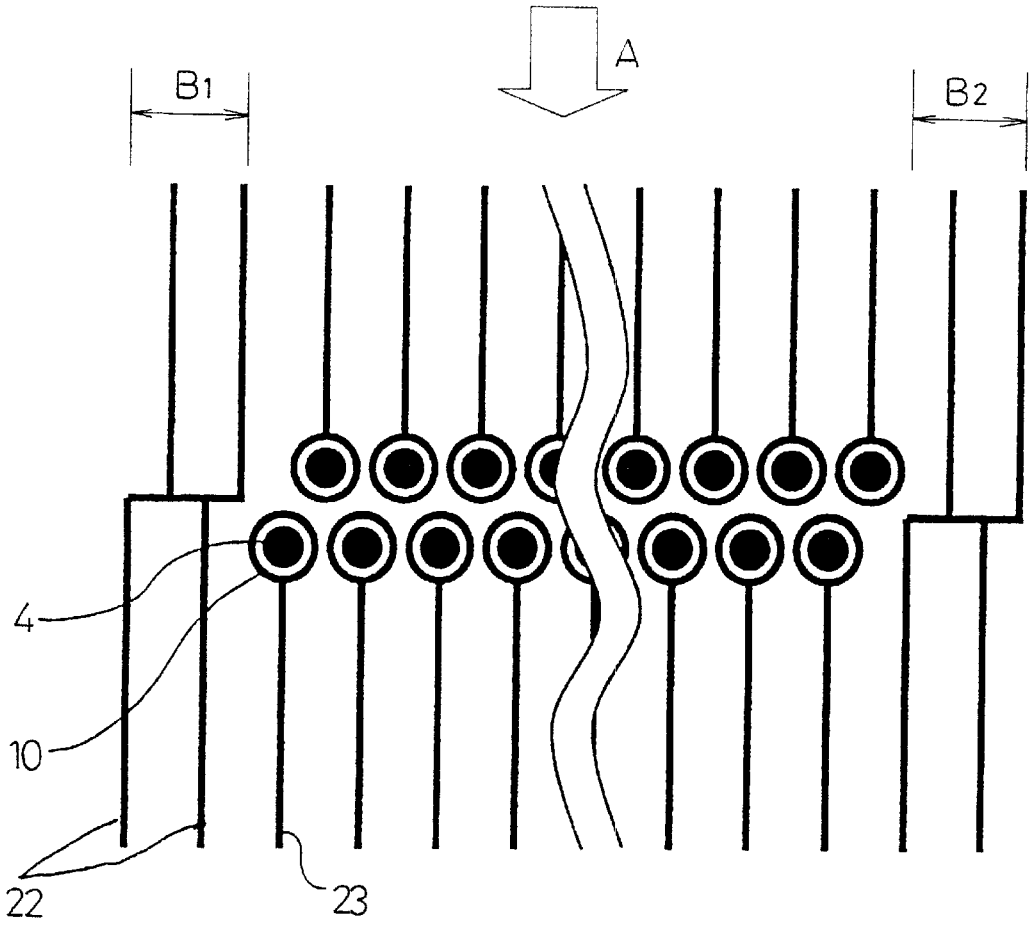
FIG. 6 illustrates an upper view of the toner passing controller of the image forming device seen from the toner carrier according to the second embodiment of the present invention.

In this embodiment, the lead line like external electrode is installed in the area of B1 and B2 as shown in FIG. 6. FIG. 6 is an upper view of the toner passing controller 3 of this embodiment seen from the side where the toner carrier 1 is arranged. In FIG. 6, the arrow A indicates the rotational direction of the toner carrier 1 (not shown in the figure), rotating during the operation of the image formation, and the moving direction of the image receiving member 7. The toner passing hole 4 is arranged in the direction X with two rows and the ring like control electrode 10 is installed around each toner passing hole 4. A lead line 23 connects each control electrode 10 and the driver IC 13 (not shown in the figure) which supplies a voltage pulse to each control electrode 10. An external electrode 22 is arranged with lining up in the lead line 23 outside the image forming area (area B1 and B2). Further, an interrupting voltage shown as a two-point chain line in FIG. 3 is always applied to the external electrode 22 during the image forming operation. The toner passing controller 3 having the above-mentioned constitution implements the image forming operation by being arranged as same as the first embodiment.

In the above constitution, the external electrode 22 accomplishes the same action as the control electrode 10 of the areas of B1 and B2 in the first embodiment. Hence, the uniform electric field is formed in the direction X between the toner carrier 1 and the control electrode row 5 without making the electric power lines sparse at the control electrode 10 corresponding to the right and left ends of the image receiving member 7. Accordingly, a high quality toner image without the irregularity of the image density among the center part and the ends of the right and left of the image receiving member 7 is formed on the image receiving member 7. Further, the toner layer on the toner carrier 1 passes through the vicinity of the lead line 23 row and the external electrode 22 arranged in B1 and B2 while the toner layer is transported to the toner passing hole 4. Toner on the toner carrier never moves to the vicinity of the B1 and B2 areas before it reaches the toner passing hole 4 since a voltage with the same polarity as that of toner in the lead line 23 row is applied in the area of B1 and B2. Therefore, printing is available at the center part and both ends of the image with the same condition of the thickness of the toner layer since toner is not dropped out at both ends of the toner layer in the longitudinal direction and supplied to the toner passing hole 4.

Further, as shown in the embodiment, the alternating current voltage reversing its polarity may be superimposed to the external electrode 22 in the area of B1 and B2, except applying a voltage of the same polarity as that of toner. For instance, toner with inverse polarity coexisting in the toner layer on toner carrier 1 is attached to the electrode in the areas of B1 and B2 when a direct current fixed voltage is applied to the electrode in the areas of B1 and B2. Toner is accumulated on the electrode of the areas of B1 and B2 by repeating the image forming operation for a long time. Accordingly, the problem of varying the distance between the toner carrier 1 and the toner passing controller 3 occurs. The electric field where toner with inverse polarity is moved to the side where the toner carrier 1 is arranged is formed by superimposing the alternating current voltage.

Third Embodiment

Figure 7:
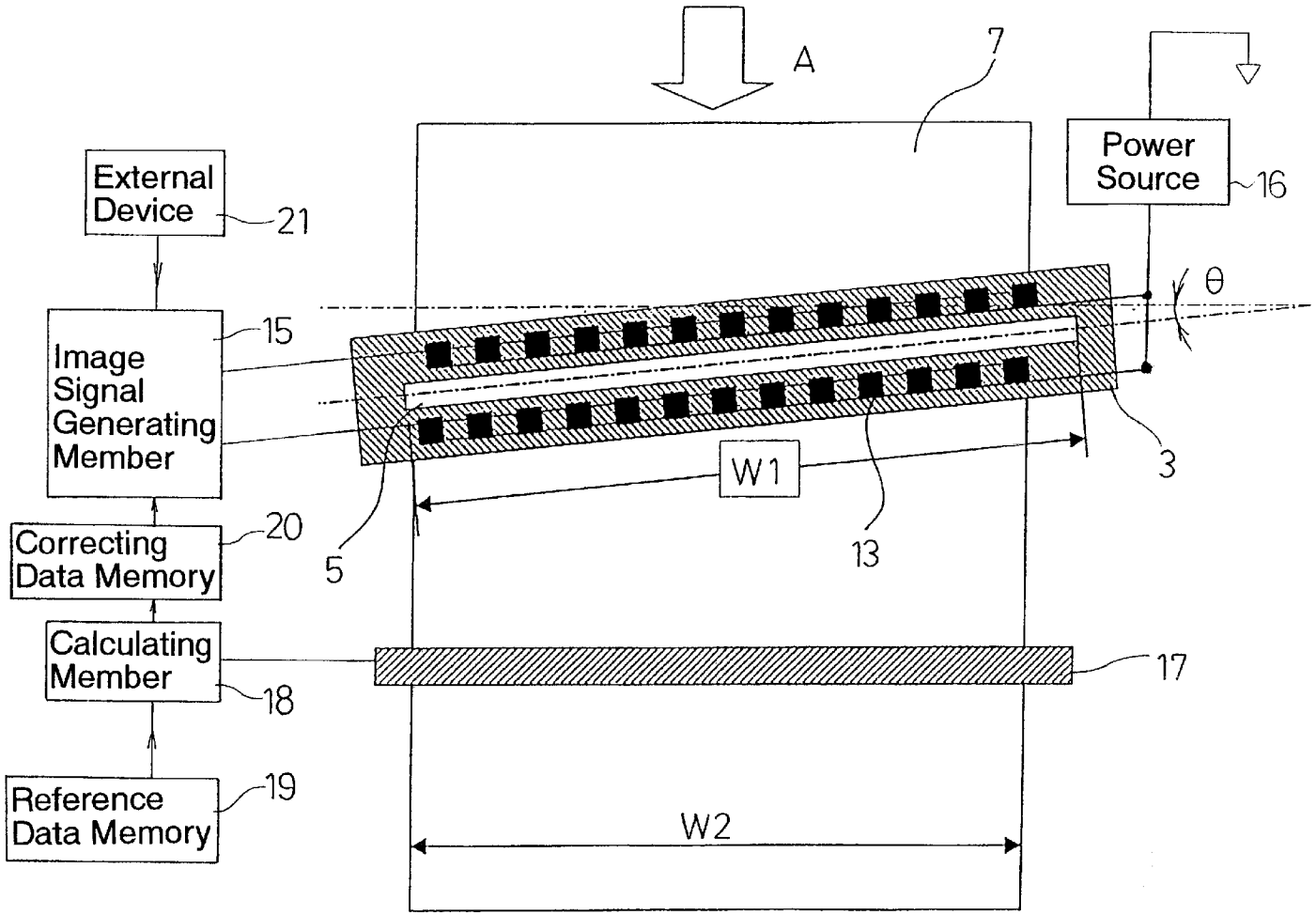
FIG. 7 illustrates an upper view of the toner passing controller of the image forming device seen from the toner carrier according to the third embodiment of the present invention.

FIG. 7 is an upper view when image receiving paper is seen from the toner carrier 1 through the toner passing controller 3 in the third embodiment. A direction perpendicular to the transported direction of an image receiving paper is defined as the direction X and a transported direction of an image receiving paper is defined as the direction Y as well as FIG. 5.

In FIG. 7, the toner passing controller 3 has the deflection electrodes 11*a* and 11*b* shown in FIG. 2. Further, each control electrode 10 is installed in the toner passing controller 3 so that the width in the direction X of the control electrode row 5 may broaden more than the width of the image forming area.

It is preferable that the installation position of the toner passing controller 3 is parallel in the direction X as shown in the first embodiment. However, high accuracy is needed for the installing position of the toner passing controller 3. In addition, a regulated clearance is needed between the toner passing controller 3 and the image forming device in order to make the detaching operation easy in case when the toner passing controller 3 is detachable from the image forming device. Hence, it is difficult to install the toner passing controller 3 in the image forming device to become parallel surely in the direction X. Therefore, the toner passing controller 3 has the angle θ to the direction X and is installed in this embodiment as shown in FIG. 7. In addition, the toner passing controller 3 is shifted with ΔX and ΔY from a regular position in each direction X and Y.

A detection member 17 detects the position of a toner image formed on the image receiving member 7. A calculating member 18 receives the detection signal supplied from the detection member 17. A reference data memory 19 memorizes the image information in the state that the toner passing controller 3 is regularly arranged and supplies the image information to the calculating member 18. A correcting data memory 20 stores the correcting data calculated by the calculating member 18 referring to the reference data memory 19. The correcting data memory 20 is connected with an image signal generating member 15, and supplies the stored and correcting data to the image signal generating member 15. Further, reference numeral 21 is an external device such as a computer, supplying an image data to the image signal generating member 15.

In the above-mentioned constitution, a horizontal line with the angle θ for the direction X is formed when an image is formed with the usual state. For instance, when θ is 0.5 degree and W2 is 180 mm, the value of the shift between the left end and the right end in the direction Y of a horizontal line formed in the image receiving member 7 becomes the following;

$$W2 \tan\theta = 180 \times \tan 0.5 = 1.57 \text{ [mm]}.$$

Further, It is necessary to form an image with correcting angle θ, ΔX, and ΔY since the toner passing controller 3 is installed with shifting by ΔX in the direction X and ΔY in the direction Y.

The correcting procedure and the image forming operation it procedure will be explained in detail with reference to FIG. 7, FIG. 8, and FIG. 9 thereafter.

Figure 8:
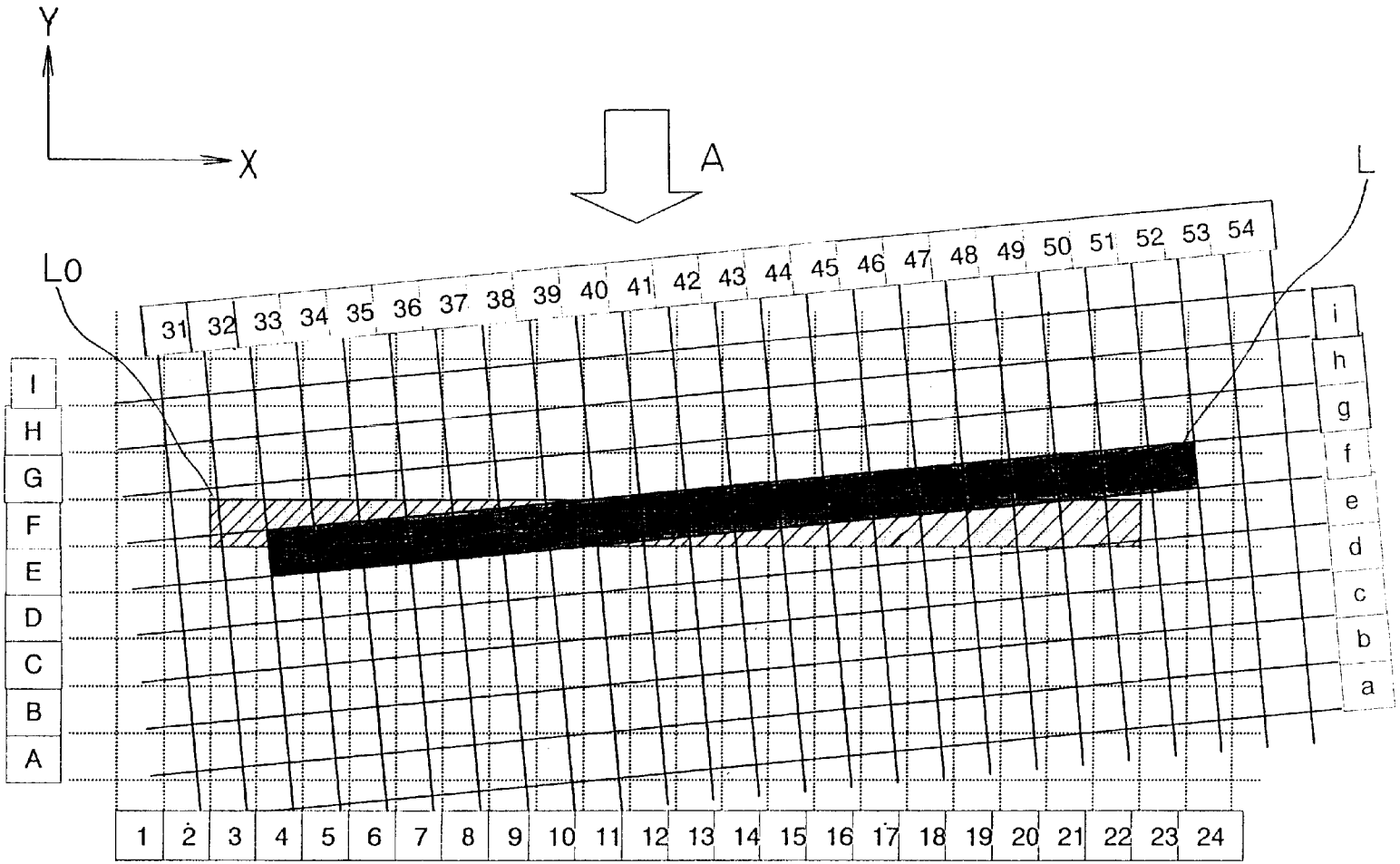
FIG. 8 is an explanatory diagram of a printed area matrix of the toner passing controller before correction according to the embodiment.
Figure 9:
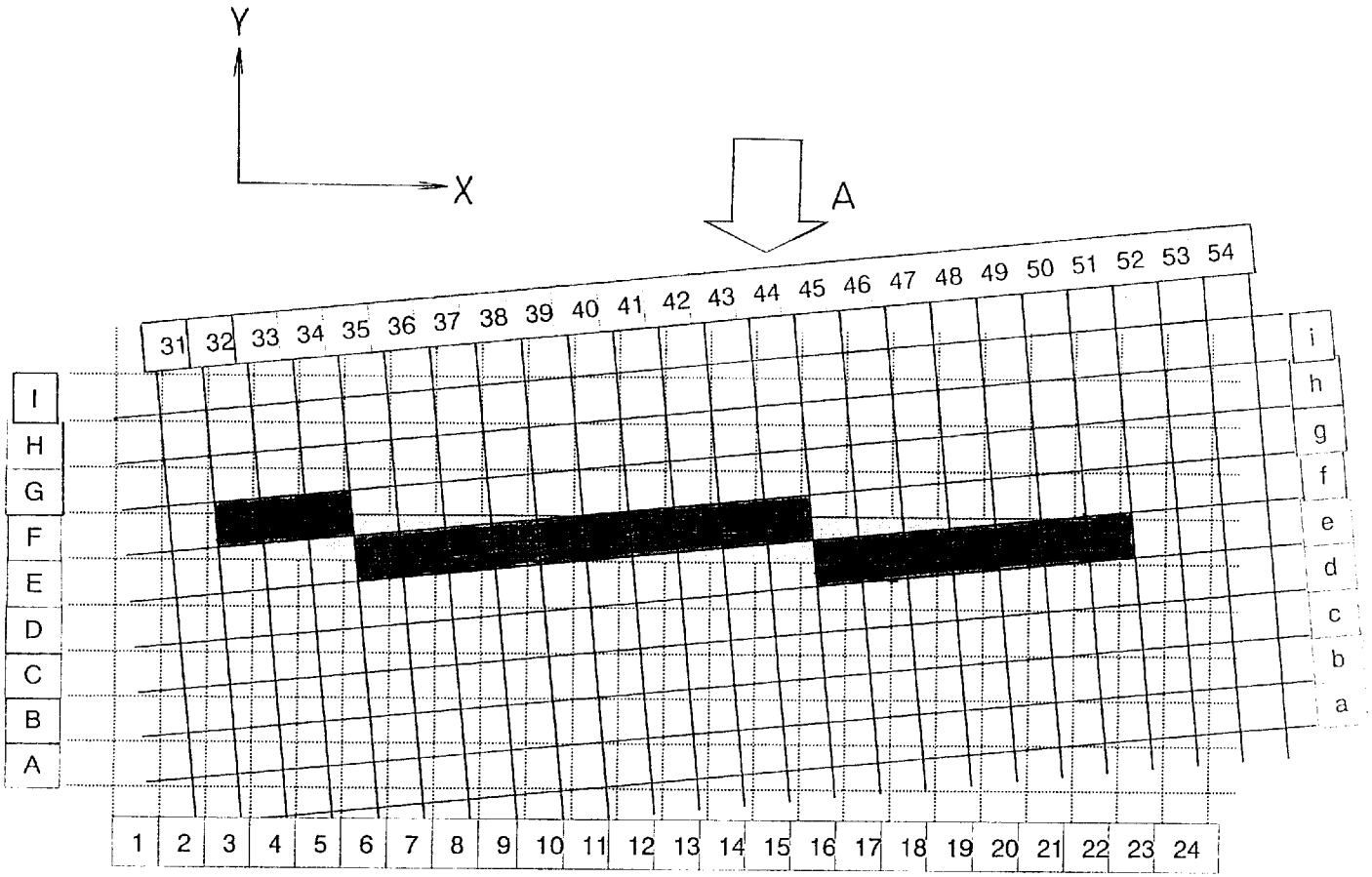
FIG. 9 is an explanatory diagram of a printed image after correction according to the embodiment.

FIG. 8 and FIG. 9 show the image formed area matrix of the toner passing controller 3. A block of each matrix denotes one pixel. In FIG. 8 and FIG. 9, a matrix of dot lines shown by lines 1–24 and rows A–I shows a pixel area where image formation is possible when the toner passing controller 3 is arranged at a regular position. Further, a matrix of solid lines shown by lines 31–54 and rows a–i shows the area where image formation is possible by the toner passing controller 3 arranged with angle θ, ΔX, and ΔY. For instance, the pixel is described as A1 when it is located at a row A and a line 1, the pixel as i54 when it is located at a row i and a line 54 thereafter. Further, FIG. 8 shows a printed image before correction and FIG. 9 after correction.

First, the correcting operation is done before the image forming operation begins. The image receiving member 7 is transported in the direction of the arrow A of FIG. 7 in the beginning. The horizontal line L shorter than W2 is formed in the toner passing controller 3 on the image receiving member 7 when the image receiving member 7 is transported to the position opposed to the toner passing controller 3. In case when an image is formed with installing the toner passing controller 3 at a regular position, the ideal horizontal line L0, shown as F3–F22 in the matrix of FIG. 8 and FIG. 9, is formed. Information regarding the address of the matrix corresponding to this ideal horizontal line L0 is memorized in the reference data memory 19 in advance. On the other hand, in this embodiment, the horizontal line L shown as f33–f52 in the matrix of FIG. 8 and FIG. 9 is printed on the image receiving member 7 since the toner passing controller 3 is installed with angle θ, ΔX, and ΔY.

The horizontal line L is held by the image receiving member 7 and transported to the position opposed to the detection member 17. Then, the position of the right and left ends of the horizontal line L, namely, f33, f52 in the directions X and Y are detected. Information regarding the position of f33, f52 in the direction X and Y is transmitted to the calculating member 18. The calculating member 18 calculates the angle θ based on information regarding the position of f33, f52 in the direction X and Y. Further, information regarding the address of ideal horizontal line L0 is transmitted from the reference data memory 19 to the calculating member 18. Accordingly, ΔX and ΔY are obtained by comparing the positions of f33 with F3 or f52 with F22 in the direction X and Y by the calculating member 18. Hence, the correcting data table correcting the addresses of image data by the above calculated angle θ, ΔX, and ΔY is formed and stored in the correcting data memory 20.

Next, the image forming operation is explained. The image forming operation is started by the instruction from an external device 21 such as a computer. The image signal generating member 15 corrects the addresses of image data supplied by the external device 21 based on the correcting data table stored in the correcting data memory 20. For instance, as shown in FIG. 9, the addresses of g32–g34, f35–f44, and e45–e51 are selected and corrected in order to form dots in the area of F3–F22.

Further, the image signal generating member 15 converts image data into image signal and supplies image signal to the driver IC 13 after correcting the addresses of image data as above-mentioned. At the same time, the image receiving member 7 is transported to the position opposed to the toner passing controller 3 along with the arrow A. The desired voltage shown in FIG. 3 is selectively supplied from the power source 16 to the control electrode 10 according to the above-mentioned image signal. Hence, the toner held on the toner carrier 1 (not show in the figure) passes the toner passing hole 4 installed inside of each control electrode 10 and is deposited on the image receiving member 7. Accordingly, when an image is formed for the area of F3–F22 shown in FIG. 9 for instance, dots are formed in the blocks of g32–g34, f35–f44, and e45–e51.

Regarding the further image forming operation, the correcting operation from the detection member to the calculating member may be omitted since information regarding a relative position of the toner passing controller 3 is stored in the correcting data memory 20.

Figure 10:
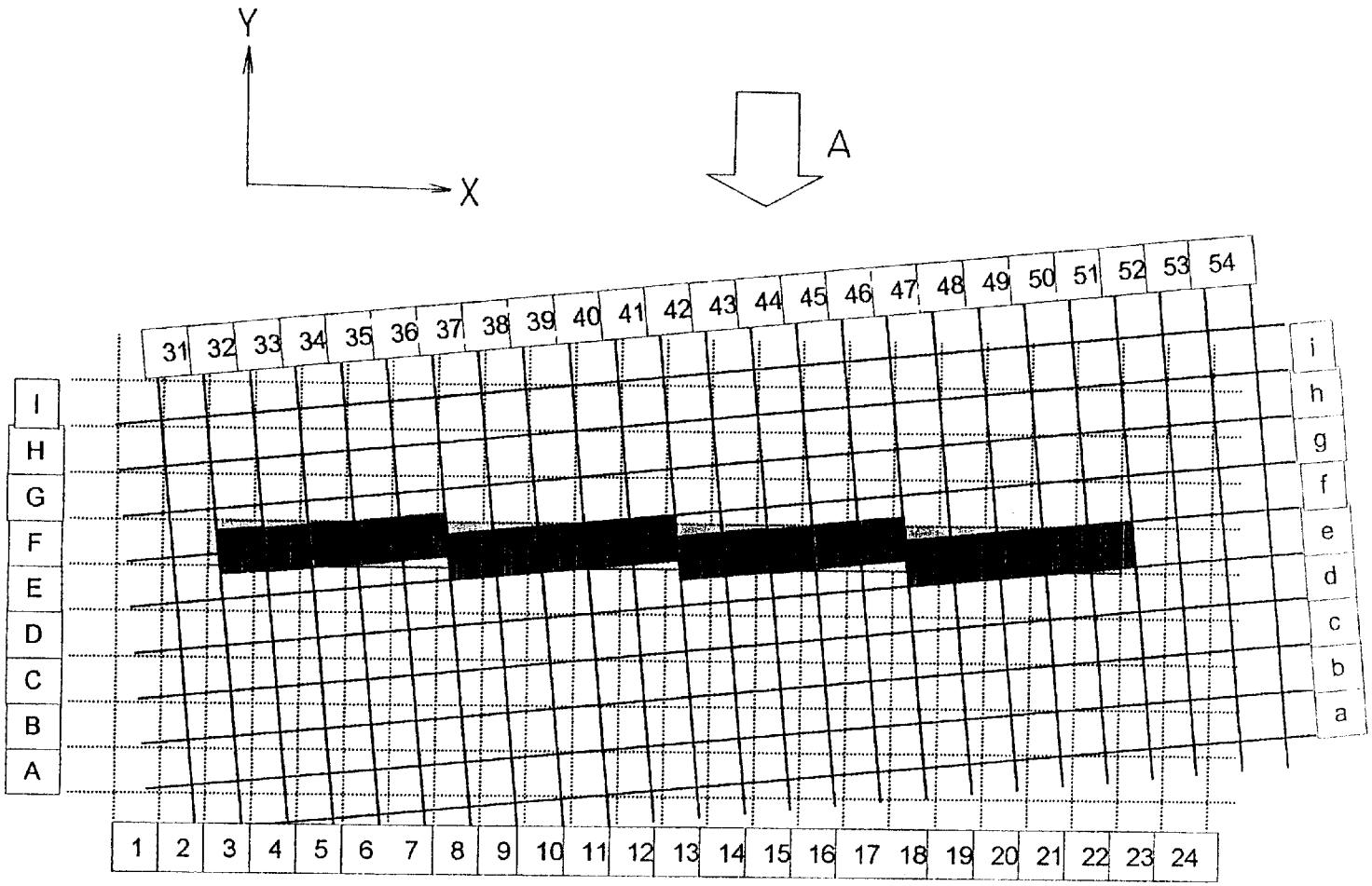
FIG. 10 is an explanatory diagram of a corrected print image by delaying a voltage pulse of ½ pixel according to the embodiment.
Figure 11:
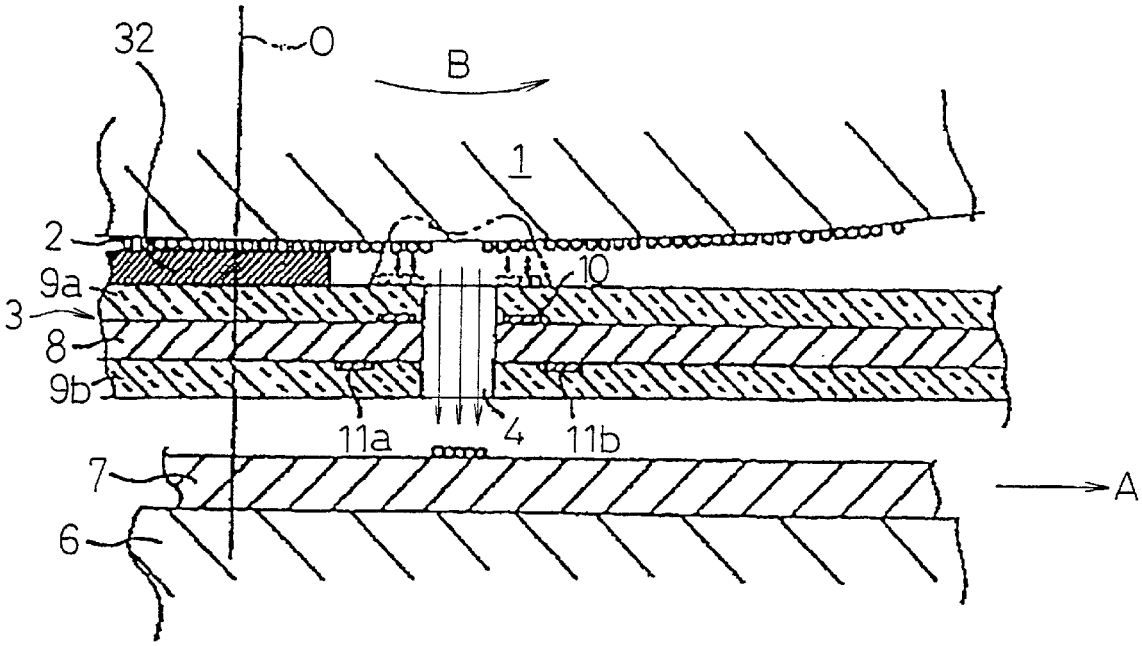
FIG. 11 illustrates a front view of the cross section of the main part of an image forming device according to a fourth and fifth embodiments in the present invention.

In the above-mentioned method, it does not become a smooth straight line since the row g, the row f, the row e, are shifted by one pixel. In order to form a smooth straight line, there is a method of applying voltage pulse to the control electrode 10 by delaying its applying time from the period for forming one pixel. For instance, FIG. 10 shows the correction result when applying the voltage pulse is delayed by a ½ pixel. In addition, it is possible to approximate to a smooth straight line by shortening delay time such as a ¼ pixel and a ⅛ pixel and controlling timing for applying pulse voltage. However, in the method of changing the orbit of flying toner by using the deflection electrodes 11*a* and 11*b* which are common to each toner passing hole 4, the value of an applied voltage is changed in synchronization with the period for forming one pixel. Hence, there is a possibility where the flying orbit of toner is deflected before the time when toner reaches the image receiving member if the time for applying voltage pulse to the control electrode 10 is delayed. Therefore, each toner passing hole 4 needs the deflection electrode and the bias voltage supplying member, which is controlled independently.

According to this embodiment, the control electrode row 5 is installed in the toner passing controller 3 with the wider range than the width of the image forming area beforehand. Hence, it is possible to correct the position of the toner passing controller 3 to the regular position of the image formation, even if such position is shifted in the direction X since an entire image forming region is covered by the row. Such correction method may be also applied for a color image forming device where a plurality of color toner carriers 1 and a plurality of toner passing controllers 3 corresponding to each of the toner carriers 1 are used. Accordingly, even if the toner passing controller 3 for each color is not arranged at a is regular position, the color blur is corrected.

Here, information of ΔX, ΔY, and angle θ is stored in the correcting data memory 20 as a correcting data table. Hence, the above-mentioned correcting operation is not needed every image forming operation. For instance, when the toner passing controller 3 is detachable from the main body of the image forming device, it is enough to execute the above-mentioned correcting operation immediately after the toner passing controller 3 is installed in the main body of the image forming device.

Further, when the toner passing controller 3 is fixed to the main body of the image forming device for instance, it is enough to complete the above-mentioned correcting operation immediately before the shipment from a factory. In this case, the detection member 17, the reference data memory 19, and the calculating member 18 become unnecessary except correcting work and regular maintenance, etc. immediately before the shipment from a factory. Hence, it is not necessary to install them in preparation for the main body of an image forming device after shipping from the factory. Accordingly, an image forming device with inexpensive price and a little number of parts is provided.

Further, it is desirable to execute the above-mentioned correcting operation properly after the prescribed numbers of sheets are printed or when the environment of a device is changed. The toner passing controller 3 whose substrate is made of a polyimide resin shown in the embodiment absorbs humidity easily and the size thereof is changed thereby.

Further, the image receiving member 7 may be composed of the recording paper carrier rotating and moving along the direction of the arrow A and recording paper such as plain paper or an OHP seat held and carried by the recording paper carrier. The correcting operation and the image forming operation in this constitution are as follows. First, the horizontal line used for the positional correction of the toner passing controller 3 is formed directly on the recording paper carrier. The horizontal line is detected by the detection member afterwards. Then, it is removed from the recording paper carrier by the cleaning member. Next, recording paper is held on the recording paper carrier and is transported to the position opposed to the toner passing controller 3. The toner passing controller 3 deposits toner selectively on the recording paper according to the image signal corrected based on the detection signal generated by the detection member 17. Under the above-mentioned operation, it is advantage that there is no waste of recoding paper since recording paper is not used for positional correction.

Similarly, the image receiving member 7 may be constituted as an intermediate transfer member and a toner image formed on the intermediate transfer member may be transferred to recording paper such as plain paper and an OHP seat. The horizontal line for positional correction is formed on the intermediate transfer member. Hence, the same effect as the image receiving member composed of the above-mentioned recording paper and the recording paper carrier is achieved. At the same time, a steady toner image is formed on recording paper without depending on a thickness and electric resistance of the recording paper since toner image is not formed directly to recording paper.

Next, fourth and fifth embodiments of an image forming device of the present invention will be explained thereafter with reference to FIG. 11–FIG. 17. A whole constitution is similar to the 1st–3rd embodiments. However, in FIG. 11, a spacer 32 is arranged in the upstream side of the rotating direction of the toner carrier 1 from the toner passing hole 4. This spacer 32, installed on the toner passing controller 3, comprises a maintaining member to maintain the distance Lk between the toner carrier 1 and the toner passing controller 3 constantly with the value of about 5–50 microns by contacting with the toner layer. A material of the spacer 32 is a metallic film such as stainless steel and aluminum or a plastic film such as PET, PTFE, and polyimide. However, it is desirable to be an insulating material.

Figure 12:
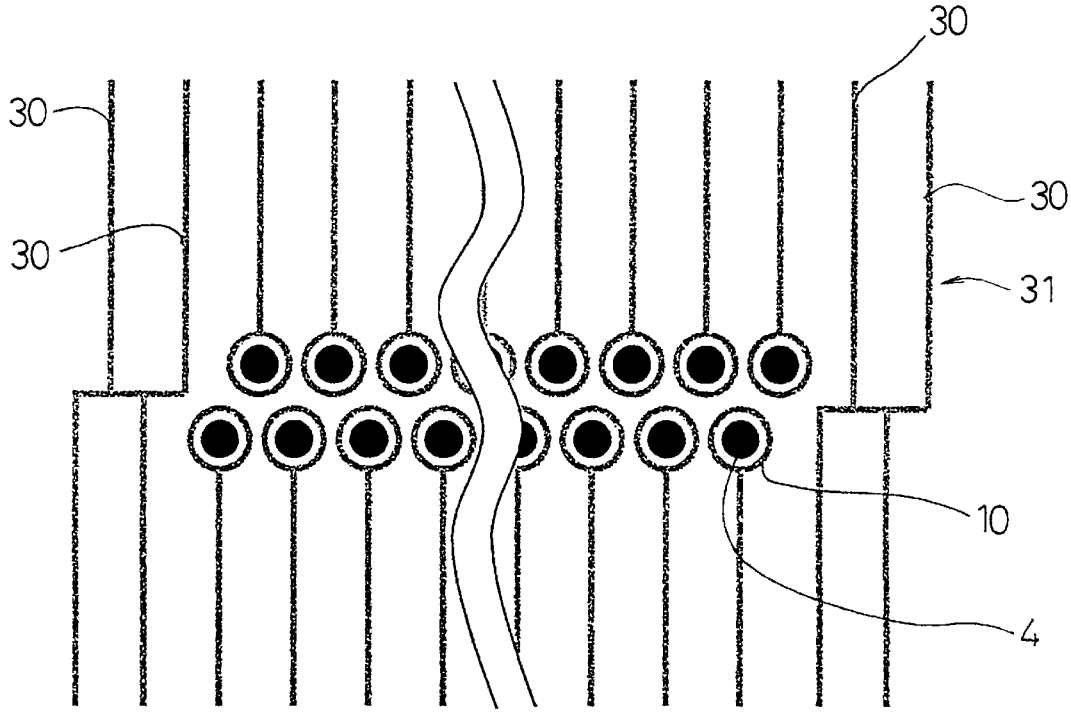
FIG. 12 illustrates the installation of the control electrode and the dummy electrode on the toner passing controller according to the embodiment.

Further, as shown in FIG. 12, it is desirable to install the external electrode 30 as a dummy electrode outside both ends of the control electrode row, installed in the longitudinal direction of the control electrode 10. By applying the voltage equal to that applied to the control electrode 10 to this external electrode 30, the electric field formed between the control electrode 10 at the outermost end of the longitudinal direction and the toner carrier 1 becomes an electric field equal to the center part of the control electrode row without diffusing. Hence, the decrease of an image density at both ends of the right and left of a printed image is suppressed. The electrode row 31 is composed of the row of these control electrodes 10 and the external electrode 30.

In the image forming device of the above-mentioned basic constitution and operation, the correlation regarding the width in the longitudinal direction of each component is set as follows in the fourth embodiment.

Figure 13:
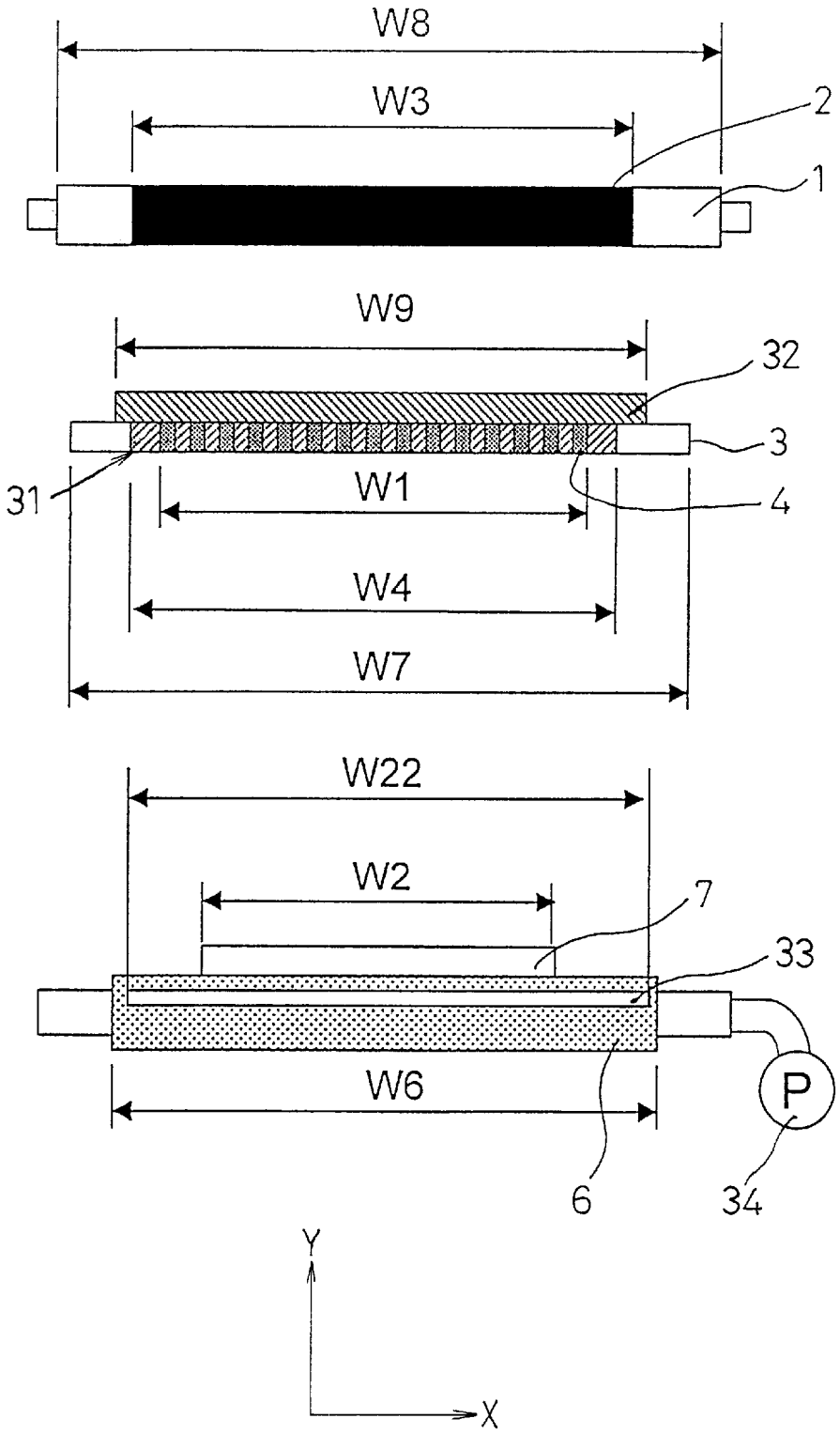
FIG. 13 is a constitution comparison diagram comparing widths of components in the longitudinal direction according to the fourth embodiment of the present invention.

FIG. 13 shows the comparison of widths in the longitudinal direction of the respective components. A longitudinal direction of each component in FIG. 13 is defined as a direction X and a direction perpendicular to the direction X is defined as a direction Y. In FIG. 13, the toner passing controller 3 includes at least one row of the toner passing hole 4 in the direction X. The electrode row 31 in the direction X is constituted by installing the control electrode around each toner passing hole 4 and the dummy electrode additionally outside both ends of the toner passing hole 4 rows. The spacer 32 is made of material with the high nonconductivity and the coefficient of low friction such as PTFE. The image receiving member 7 is composed of plain paper or an OHP form.

Further, the backside electrode 6 is made of a hollow conductive material and the slit 33 opened with penetrating the surface thereof is provided. The backside electrode 6 rotates immediately after turning on the main power source for the image forming device, before starting the printing operation or after finishing of the printing operation. The slit 33 stops at the position opposed to the toner passing controller 3. A fixed absorbing pump 34 is connected with the end of the backside electrode 6. Airflow is absorbed from the slit 33 through the backside electrode 6 by the operation of the absorbing pump 34. Toner, attached within the toner passing hole 4 in the toner passing controller 3 and the surface of the side where the backside electrode 6 is arranged, is drawn and removed to the drawing pump 34 through the slit 33. Further, the backside electrode 6 rotates again immediately before beginning of the printing operation, and the slit 33 stops at the position not opposed to the toner passing controller 3, at the same time, a desired voltage is supplied and the electric field is formed thereby between the toner carrier 1 and the toner passing controller 3 so that toner flies to the side where the backside electrode 6 is arranged.

In this constitution, when the image forming operation is repeated for a long time a protecting layer 9*a* provided on the surface of the toner passing controller 3 at the side of the toner carrier 1 is gradually ground by contacting with the toner carrier 1. Hence, the thickness of the layer becomes thin. The insulating function is decreased when the thickness of the protecting layer 9*a* becomes thin. Accordingly, it enters the state that the electric discharge phenomenon occurs easily between the toner carrier 1 and electrodes on the toner passing controller 3.

Therefore, in this embodiment, the width in the direction X of the toner layer 2 is W3, the width in the direction X of the electrode row 31 containing the control electrode and the dummy electrode is W4 and the condition, W3>W4 is satisfied. Further, both right and left ends of the toner layer 2 are arranged outside both right and left ends of all electrode rows 31.

In this constitution, all electrode rows 31 are opposed to the toner layer 2 without being opposed directly to the surface of the toner carrier 1 in all the areas. Therefore, the toner layer 2 acts as an insulation layer even when a voltage of hundreds of volts is applied to the electrode row 31. Hence, the electric discharge phenomenon between the electrode row 31 of the toner passing controller 3 and the toner carrier 1 is suppressed.

Further, the width in the direction X of the spacer 32 is W9 and the condition, W9>W4 is satisfied. Both ends of the right and left of the spacer 32 are arranged outside both right and left ends of all electrode rows 31.

Under the constitution, all electrode rows 31 are opposed to the spacer 32 without being opposed directly to the toner carrier 1 which adjacent to it at most in all the areas. Hence, even when a voltage of hundreds of volts is applied to the electrode row 31, the electric discharge phenomenon between the electrode row 31 of the toner passing controller 3 and the toner carrier 1 is suppressed since the spacer 32 is composed of an insulating material.

Further, in the prior art, the surface of the toner passing controller 3 facing the toner carrier in the region where electrode row 31 is arranged is risen like convex. When the toner carrier 1 is contacted with the toner passing controller 3, the protection layer 9*a* in a convex part on the surfaces of the toner passing controller 3 is easily worn out. Accordingly, there is a problem of exposing the electrode row 31 on the toner passing controller 3. On the other hand, in the above-mentioned constitution, the convex part on the surface of the toner passing controller 3 does not contact directly with the toner carrier 1. The problem of worn out of the protection layer 9*a* in the convex part is avoided.

Further, the condition, W9>W3 is satisfied and both ends of the right and left of the spacer 32 are arranged outside both ends of the right and left of the toner layer 2.

In this constitution, both ends of the right and left of the spacer 32 are not contacted with the toner layer 2 on the toner carrier 1. Therefore, the toner layer 2 is not disarranged by contacting ends of the spacer 32 on the toner carrier 1 and transported up to the row of the toner passing hole 4 with the uniform state extended in the direction X. Further, the toner 2 is peeled and dropped from the toner carrier 1 at the end of the spacer 32 and is not accumulated on the toner passing controller 3. Hence, the problem, that the toner carrier 1 is gradually separated from the toner passing controller 3 by growing the toner 2 sandwiched between the toner carrier 1 and the toner passing controller 3, is prevented. Furthermore, the toner carrier 1 is not damaged by the end of the spacer 32 in the area opposed to the electrode row 31 on the toner passing controller 3. Hence, the problem, that the electric discharge phenomenon between the toner carrier 1 and the toner passing controller 3 occurs by concentration of the electric field on the ruggedness of the scratch formed on the surface of the toner carrier 1, is prevented at the same time.

Further, the width in the direction X of the toner passing controller 3 is W7, and the condition, W7>W9 is satisfied. Both the right and left ends of the toner passing controller 3 are arranged outside both the right and left ends of the spacer 32.

In this constitution, the spacer 32, pressed to the direction of the toner passing controller 3 by the toner carrier 1, is not contacted with the right and left ends of the toner passing controller 3. Hence, the stress concentration on the spacer 32 by the end of the toner passing controller 3 is not generated. Therefore, the distance between the toner carrier 1 and the toner passing controller 3 is kept constant by the spacer 32 since the deformation of the spacer 32 by the end of the toner passing controller 3 does not occur.

Further, the width in the direction X of the toner carrier 1 is W8, and the condition, W8>W9 is satisfied. Both the right and left ends of the toner carrier 1 are arranged outside both the right and left ends of the spacer 32.

In this constitution, the concentration of the stress on the spacer 32 by both ends of toner carrier 1 is avoided since the end of toner carrier 1 does not contact directly with the spacer 32. Therefore, the distance from the toner carrier 1 to the toner passing controller 3 is kept constant even if the toner carrier 1 is contacted with the toner passing controller 3 through the spacer 32 for a long time since the deformation of the spacer 32 by the stress concentration does not occur.

Further, there is the following another problem in the prior art. Namely, in the toner passing controller 3, the drawing power toward the slit 33 of the backside electrode 6 works with the drawing pump 34. It becomes easy to concentrate the stress on the surface opposed to the slit 33 among surfaces of the toner passing controller 3 facing backside electrode 6 since the toner passing controller 3 is fixed. Especially, the stress concentration is remarkable in the toner passing controller 3 opposed to the right and left ends in the slit 33. Accordingly, the toner passing controller 3 is deformed. When the deformation by the stress concentration is occurred in the area where the electrode row 31 on the toner passing controller 3 is arranged, it becomes easy to concentrate the electric field on the convex portion of the toner passing controller 3 opposed to the backside electrode 6. Accordingly, the electric discharge phenomenon occurs between the backside electrode 6 and the convex portion of the deformed toner passing controller 3.

In order to solve the above problem, under this embodiment, the width in the direction X of slit 33 is W22 and the condition, W22>W4 is satisfied. Both the right and left ends of the slit 33 are arranged outside both the right and left ends of the electrode row 31.

In this constitution, an electrode does not exist in the toner passing controller 3 opposed to the right and left ends of the slit 33. Therefore, even if the deformation of the toner passing controller 3 by the stress concentration occurs, the electric discharge phenomenon between the backside electrode 6 and the deformed portion of the toner passing controller 3 is avoided since an electrode does not exist in the deformed portion.

In the above-mentioned constitution, it is possible to have steady image formation for a long period of time without destructing the toner passing controller 3 and the surface of the toner carrier 1 by the electric discharge. Furthermore, the distance between the toner carrier 1 and the toner passing controller 3 is kept balance at the same time as toner being transported to toner passing hole 4 with the state of uniformed toner layer 2.

Further, the following problem exists other than the above-mentioned. Namely, when the distance between the backside electrode 6 and the toner carrier 1 is hundreds of microns, the voltage of 1 kV or more supplied to the backside electrode 6 comes to be a voltage value close to the beginning of the electric discharge. Therefore, when the toner carrier 1 slightly approaches the backside electrode 6, the electric discharge phenomenon occurs between them. Especially, the electric field is concentrated easily since the ends of the toner carrier 1 and the backside electrode 6 have the convex shape and the electric discharge phenomenon easily occurs.

In order to solve such a problem, the present embodiment includes the following means. Namely, in the constitution shown in FIG. 13, the widths in the direction X of the toner carrier 1 and the backside electrode 6 are W8 and W6, respectively, the width in the direction X of the toner passing controller 3 is W7, and the condition, W8>W7 is satisfied. Further, both the right and left ends of the toner carrier 1 are arranged outside both the right and left ends of toner passing controller 3. Otherwise, the condition, W6>W7 is satisfied and both the right and left ends of the backside electrode 6 are arranged outside both the right and left ends of the toner passing controller 3.

In this constitution, the end of the toner carrier 1 or the end of the backside electrode 6 does not oppose directly to the surface of the backside electrode 6 or the surface of the toner carrier 1 and the toner passing controller 3 lies between them. The toner passing controller 3 functions as an insulating material since the electrode installed on the insulative base layer 8 is covered by the insulative protecting layers 9*a* and 9*b* as the mentioned above. Accordingly, even when the voltage of 1 kV or more is applied to the backside electrode 6, the electric discharge phenomenon between the toner carrier 1 and the backside electrode 6 is suppressed by the toner passing controller 3 functioning as an insulating material. Therefore, it is possible to have the steady image formation without destructing the surface of the toner carrier 1 and the surfaces of the backside electrode 6 by the electric discharge.

Next, the fifth embodiment of the present invention is explained with reference to FIG. 14 and FIG. 15. This embodiment is different from the above-mentioned embodiment in the point to use an intermediate transfer belt as the image receiving member besides plain paper and an OHP sheet. The correlation regarding width of each component in the longitudinal direction is explained as follows.

Here, regarding the definition of the same component and its width as what explained with the fourth embodiment, the same reference sign is denoted, the explanation is omitted, and only the items relating to different components are explained.

Figure 14:
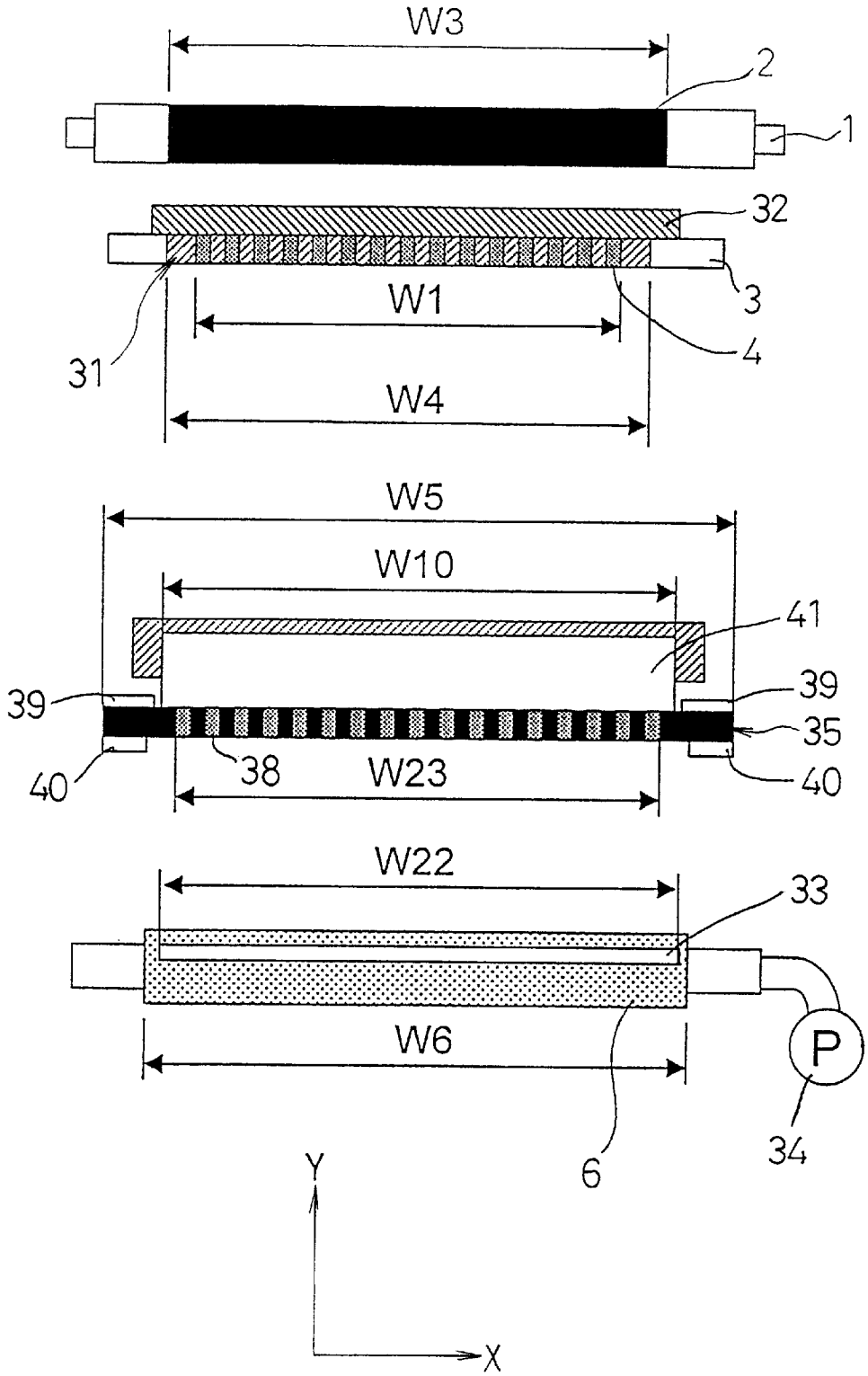
FIG. 14 is a constitution comparison diagram comparing widths of components in the longitudinal direction according to the fifth embodiment of the present invention.

In FIG. 14, a width in the longitudinal direction of each of components is compared, and the arrangement composition of the intermediate transfer belt is shown in FIG. 15. In FIG. 14, a longitudinal direction of each component is defined as a direction X and a direction perpendicular to the direction X is defined as a direction Y.

Figure 15A:
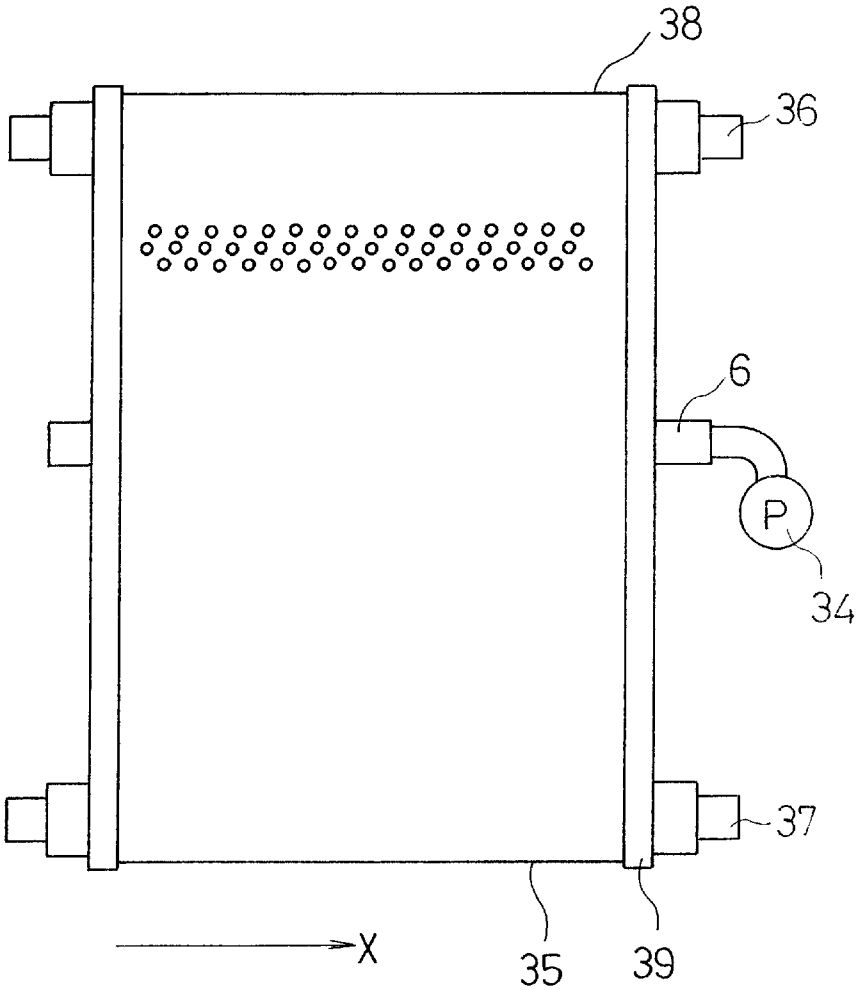
FIG. 15A and FIG. 15B show the constitution of the intermediate transfer belt according to the embodiment.
Figure 15B:
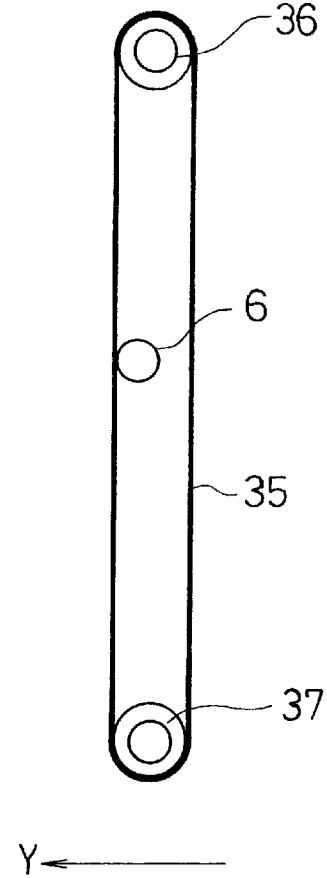
Figures 16A, 16B:
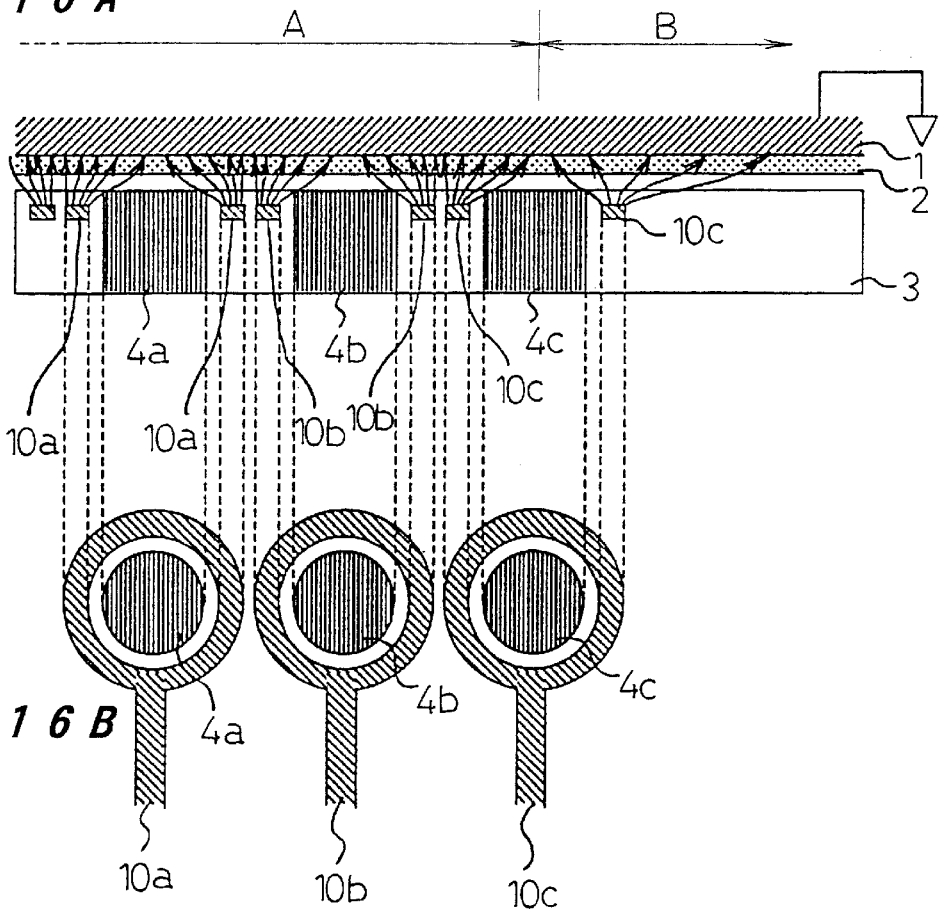
Prior Art Fig. 16A
FIG. 16A and FIG. 16B are diagrams of the vicinity of ends of the toner passing controller in an image forming device according to a prior art.
Figure 17:
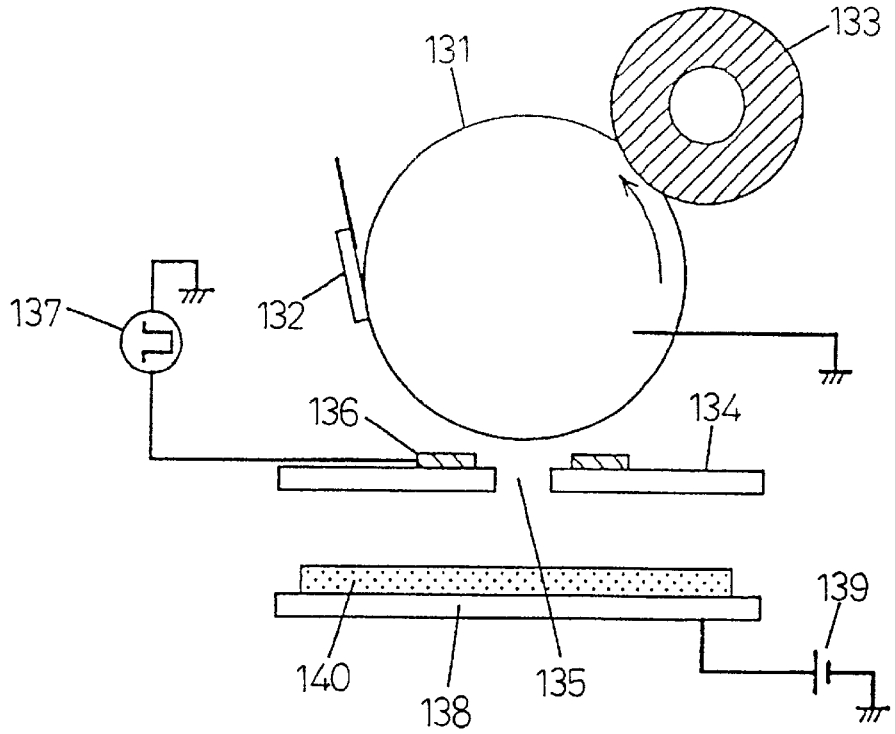
Fig. 17 Prior Art
FIG. 17 is a constitution diagram showing a basic constitution of the image forming device according to the prior art.
Figure 18:
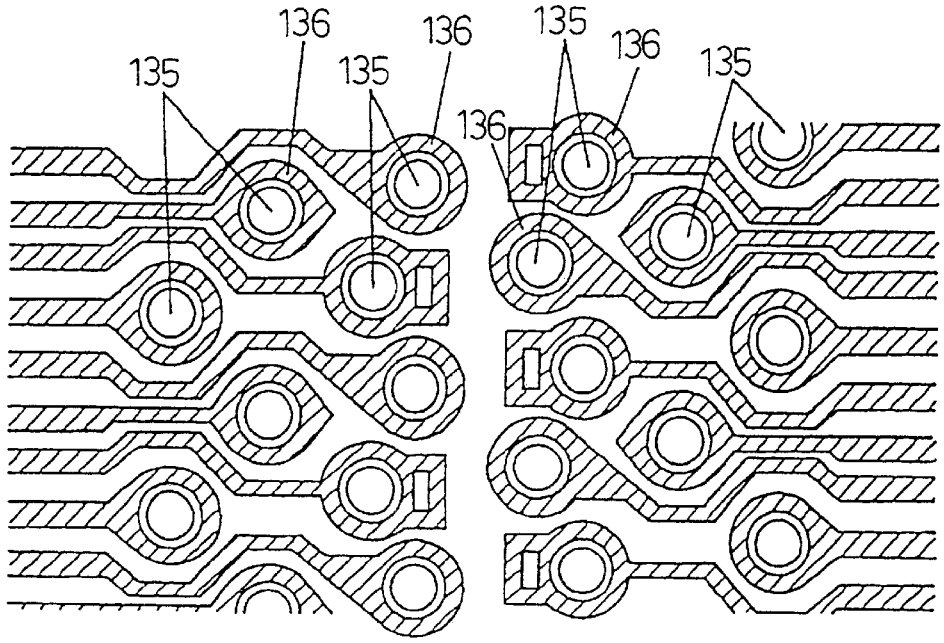
Fig. 18 Prior Art
FIG. 18 is a plan view showing the installation of the toner passing hole and the electrode according to the prior art.
Figure 19:
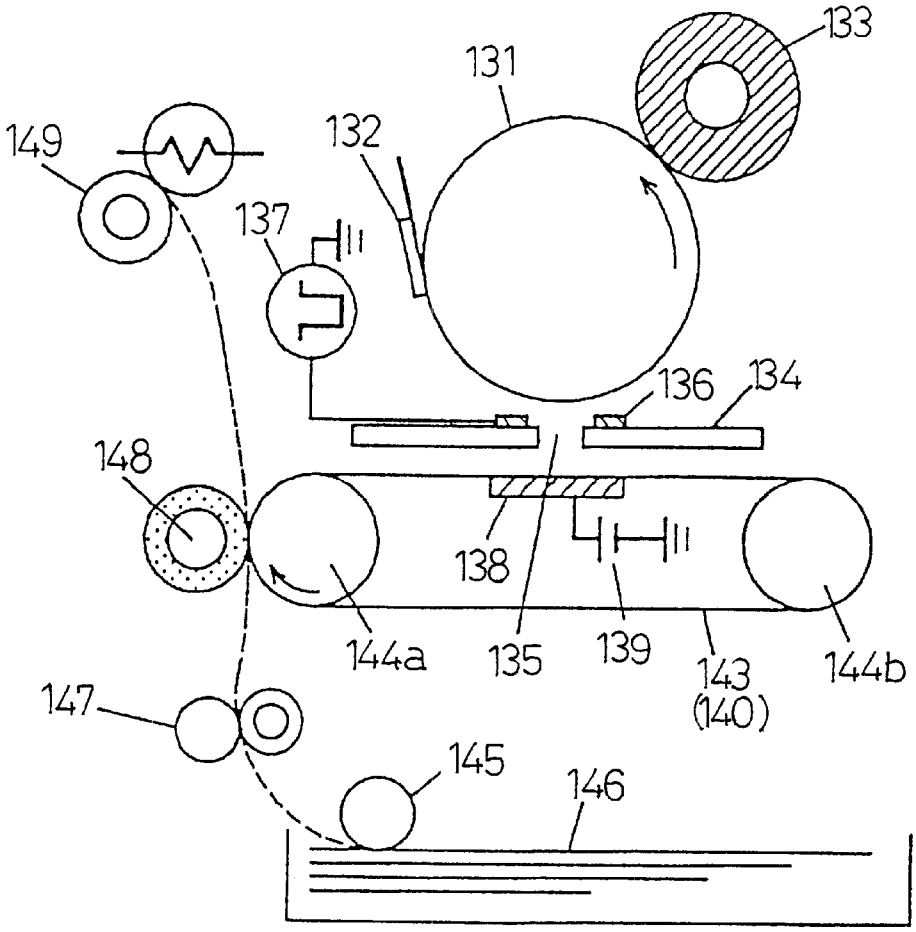
Fig. 19 Prior Art
FIG. 19 is a whole constitution diagram showing an image forming device according to another example of the prior art.

An intermediate transfer belt 35 is composed of a material obtained by mixing a binder resin such as polycarbonate resin and a PTFE resin with an electro conductive resin such as a carbon black. The surface resistance thereof is $10^{7-1011}$ Ω/□. FIG. 15A shows an upper view of the intermediate transfer belt 35 and FIG. 15B shows a side view of the intermediate transfer belt 35. The intermediate transfer belt 35 is installed and stretched by at least two rollers 36 and 37. Either or both rollers 36 and 37 are driving rollers. The intermediate transfer belt 35 also rotates along with the rotation of the driving roller. The backside electrode 6 is arranged between the rollers 36 and 37 to contact with the back of the intermediate transfer belt 35.

A lot of penetration holes 38 penetrating through the intermediate transfer belt 35 are provided in a part of the area of the belt 35. These penetration holes 38 are arranged in a plurality of rows in a zigzag fashion in the direction X.

A nonconductive reinforcement tape 39 is made of an insulating material such as a PET resin, and adhered along with the end of the surface of the intermediate transfer belt 35. Accordingly, the rigidity of the intermediate transfer belt 35 is increased and deforming the ends of the intermediate transfer belt 35 is prevented. A guide member 40 is made of a rubber material and adhered along with the back end of the intermediate transfer belt 35. A step is provided at both ends of rollers 36, 37, and the backside electrode 6. The guide member 40 slides and engages in it. Accordingly, steps provided at both ends of rollers 36, 37, and the backside electrode 6 function as a guide groove for the intermediate transfer belt 35. Hence, the skewed movement of the intermediate transfer belt 35 is prevented.

A cleaning blade 41 contacted with the intermediate transfer belt 35 is detachable. The cleaning blade 41 is separated from the intermediate transfer belt 35 when the penetration hole 38 provided in the belt 35 is moved to the position opposed to the cleaning blade 41. The cleaning blade 41 contacts with the intermediate transfer belt 35 when the penetration hole 38 passes the position opposed to the cleaning blade 41. Accordingly, toner, remained on the intermediate transfer belt 35, is removed from the surface of the intermediate transfer belt 35 by the cleaning blade 41 after a toner image formed on the intermediate transfer belt 35 is transferred to the recording paper with the transfer member (not shown in the figure).

In the above-mentioned constitution, widths in the direction X of the intermediate transfer belt 35 and the backside electrode 6 are W5 and W6, respectively, and the condition, W5>W6 is satisfied. Both the right and left ends of the intermediate transfer belt 35 are arranged outside both the right and left ends of the backside electrode 6.

In this constitution, the right and left surrounding end parts of the backside electrode 6 are not opposed directly to the toner passing controller 3. The intermediate transfer belt 35, having electric characteristics of the high and middle resistance, lies between them and the non conductivity reinforcement tape 39 lies, too. Therefore, even if a high voltage is applied to the backside electrode 6 and the electric field is concentrated on the right and left surrounding end parts of the backside electrode 6, the electric discharge phenomenon between the toner passing controller 3 and the backside electrode 6 is suppressed by the electrical shielding effect of the intermediate transfer belt 35 and the reinforcement tape 39.

Further, the width of the row of the penetration hole 38 arranged in the direction X is W23, the width of the slit 33 provided in the backside electrode 6 in the direction X is W22 and the condition, W22>W23 is satisfied. Both the right and left ends of the slit 33 are arranged outside both the right and left ends of the row where the penetration hole 38 is arranged.

The deformation of the intermediate transfer belt 35 is caused easily when the stress is concentrated since the area of existing the penetration hole 38 of the intermediate transfer belt 35 has the low rigidity. On the other hand, under the above constitution, it is possible not to make the row of penetration hole 38 exist in the portion opposed to the right and left ends of the slit 33 where stresses are concentrated easily at most by drawing with an airflow. Namely, the area of the intermediate transfer belt 35 having low rigidity which is deformed easily is not opposed to the right and left ends of the slit 33 where the stress is concentrated easily. Hence, the deformation of the intermediate transfer belt 35 by drawing with the airflow is suppressed.

The intermediate transfer belt 35 may be used as a belt for holding a recording paper. Namely, a toner image is not directly formed on the belt, instead, an image is formed on the recording paper by the way of forming a toner image on the recoding paper such as a plain paper or an OHP sheet held on the belt, separating it from the belt and passing it through the fixing device.

Further, instead of the intermediate transfer belt 35 or the belt for holding the recording paper, a member having the drum shape such as the intermediate transfer drum and a drum for holding the recording paper may be used.

INDUSTRIAL APPLICABILITY

As disclosed clearly in the above-mentioned explanation, according to an image forming device of the present invention, a uniform electric field is formed with all the control electrodes opposed to the entire image forming area and an image without irregularity over the entire width is formed thereby. Further, the electric discharge phenomenon between the electrode row and the developer carrier is suppressed by the functioning of the developer layer as an insulation layer even when a voltage of hundreds of volts is applied to the electrode row. Hence, it is useful to manage the compatibility of the stability of the image quality and the improvement of the maintenance of the image forming device.

What is claimed is:

1. An image forming device comprising:

a developer carrier (1) for carrying a charged developer (2);

a developer passing controller (3) for controlling the passing of said developer (2) by applying a voltage corresponding to an image signal to a plurality of control electrodes (10), the developer passing controller having a plurality of developer passing holes (4) through which the developer (2) passes and said control electrodes being arranged to surround the surroundings of the developer passing holes;

an image receiving member (7) for receiving said developer (2) passed through; and a backside electrode (6) for drawing said developer (2), the backside electrode being installed at the back side of said image receiving member (7), wherein the width of a control electrode row (5) in a longitudinal direction, where the control electrodes (10) are arranged, is wider than a width of an image forming area in a direction perpendicular to a moving direction of the image receiving member (7), and both ends of the control electrode row (5) in the longitudinal direction are arranged outside the width of an image forming area.

2. The image forming device according to claim 1, wherein a voltage is applied to a portion outside the width of an image forming area of the control electrode row (5) so as to obstruct the passing of said developer (2) through the developer passing hole (4) at least during time when image formation is operated.

3. The image forming device according to claim 1, wherein said developer passing holes (4) are formed only in the portion arranged inside from the maximum width of an image forming area of the control electrode row (5).

4. The image forming device according to claim 1, further comprising a correction member for correcting an address of said control electrode (10), where the image signal is supplied, based on a relative position of said developer passing controller (3) to the image receiving member (7).

5. The image forming device according to claim 4, wherein said correction member comprises a detection member (17) for detecting the relative position of said developer passing controller (3) to said image receiving member (7), a calculating member (18) for calculating correcting data based on the detection signal sent from said detection member (17), and a storage member (20) for storing the correcting data obtained from the calculating member (18).

6. The image forming device according to claim 5, wherein said detection member (17) and said calculating member (18) are detachable from the image forming device.

7. The image forming device according to any of claims 4 to 6, wherein a plurality of said developer carriers (1) and a plurality of said developer passing controllers (3) opposed to said developer carriers (1) are installed.

8. The image forming device according to any of claims 4 to 6, wherein said developer passing controller (3) is detachable from a main body of the image forming device and the correcting operation by the correction member is executed every time when said developer passing controller (3) is attached in the main body of the image forming device.

9. An image forming device comprising:

a developer carrier (1) for carrying a charged developer (2);

a developer passing controller (3) for controlling the passing of said developer (2) by applying a voltage corresponding to an image signal to a plurality of control electrodes (10), the developer passing controller having a plurality of developer passing holes (4) through which the developer (2) passes and said control electrodes being arranged to surround the surroundings of the developer passing holes;

a voltage supplying member (16) for supplying a voltage corresponding to the image signal to the control electrodes (10);

an image receiving member (7) for receiving the developer (2) passed through; and a backside electrode (6) for drawing the developer (2), the backside electrode being installed at the back side of the image receiving member (7), wherein an external electrode (22) receiving a desired voltage is installed outside at both ends of a control electrode row (5) where the control electrodes (10) are arranged.

10. The image forming device according to claim 9, wherein said external electrode (22) is extended in parallel to a lead line (23) connecting said control electrode (10) with the voltage supplying member (16).

11. The image forming device according to any of claims 9 and 10, wherein a voltage of the same polarity as that of developer (2) is always applied to the external electrode (22).

12. The image forming device according to any of claims 9 and 10, wherein an alternating current voltage is superimposed to said external electrode (22).

13. The image forming device according to any of claims 9 and 10, wherein a voltage applied to the control electrode (10), which obstructs the passing of developer (2), is applied to said external electrode (22) during time of the operation of image formation.

14. An image forming device comprising:

a developer carrier (1) for carrying a charged developer (2);

a developer passing controller (3) for controlling the passing of said developer (2) by applying a voltage corresponding to an image signal to a plurality of control electrodes (10), the developer passing controller having a plurality of developer passing holes (4) through which the developer (2) passes and said control electrodes being arranged to surround the surroundings of the developer passing holes;

an image receiving member (7) for receiving said developer (2) passed through; and a backside electrode (6) for drawing said developer (2), the backside electrode being installed at the back side of the image receiving member (7), wherein the width of an electrode row (31), arranged in an area which is adjacent to said developer carrier (1) in said developer passing controller (3), is narrower than the width of a developer layer held on said developer carrier (1), viewed from a direction perpendicular to a moving direction of said image receiving member (7), and both ends of the electrode row (31) are arranged inside both ends of the developer layer.

15. An image forming device comprising:

a developer carrier (1) for carrying a charged developer (2);

a developer passing controller (3) for controlling the passing of said developer (2) by applying a voltage corresponding to an image signal to a plurality of control electrodes (10), the developer passing controller having a plurality of developer passing holes (4) through which the developer (2) passes and said control electrodes being arranged to surround the surroundings of the developer passing holes;

a maintaining member (32) for maintaining a distance from a developer layer on said developer carrier (1) to said developer passing controller (3) constantly by contacting a developer layer on said developer carrier (1) and the developer passing controller (3);

an image receiving member (7) for receiving said developer (2) passed through; and a backside electrode (6) for drawing said developer (2), the backside electrode being installed at the back side of the image receiving member (7), wherein the width of an electrode row (31), arranged in an area which is adjacent to said developer carrier (1) in said developer passing controller (3), is narrower than the width of the maintaining member (32), viewed from a direction perpendicular to a moving direction of the image receiving member (7), and both ends of the electrode row (31) are arranged inside both ends of said maintaining member (32).

16. An image forming device comprising:

a developer carrier (1) for carrying a charged developer (2);

a developer passing controller (3) for controlling the passing of said developer (2) by applying a voltage corresponding to an image signal to a plurality of control electrodes (10), the developer passing controller having a plurality of developer passing holes (4) through which the developer (2) passes and said control electrodes being arranged to surround the surroundings of the developer passing holes;

an image receiving member (7) for receiving said developer (2) passed through; and a backside electrode (6) for drawing said developer (2), the backside electrode being installed at the back side of the image receiving member (7), wherein the width of said image receiving member (7) is wider than the width of the backside electrode (6), viewed from a direction perpendicular to a moving direction of said image receiving member (7), and both ends of said image receiving member (7) are arranged outside both ends of the backside electrode (6).

17. An image forming device comprising:

a developer carrier (1) for carrying a charged developer (2);

a developer passing controller (3) for controlling the passing of said developer (2) by applying a voltage corresponding to an image signal to a plurality of control electrodes (10), the developer passing controller having a plurality of developer passing holes (4) through which the developer (2) passes and said control electrodes being arranged to surround the surroundings of the developer passing holes;

an image receiving member (7) for receiving said developer (2) passed through; and a backside electrode (6) for drawing said developer (2), the backside electrode being installed at the back side of the image receiving member (7), wherein the width of the developer passing controller (3) is wider than either of the width of the developer carrier (1) and the width of the backside electrode (6), viewed from a direction perpendicular to a moving direction of said image receiving member (7), and both ends of the developer passing controller (3) are arranged outside either of both ends of the developer carrier (1) and both ends of the backside electrode(6).

18. An image forming device comprising:

a developer carrier (1) for carrying a charged developer (2);

a developer passing controller (3) for controlling the passing of said developer (2) by applying a voltage corresponding to an image signal to a plurality of control electrodes (10), the developer passing controller having a plurality of developer passing holes (4) through which the developer (2) passes and said control electrodes being arranged to surround the surroundings of the developer passing holes;

a maintaining member (32) for maintaining a distance from a developer layer on said developer carrier (1) to said developer passing controller (3) constantly by contacting the developer layer on said developer carrier (1) and the developer passing controller (3);

an image receiving member (7) for receiving said developer (2) passed through; and a backside electrode (6) for drawing said developer (2), the backside electrode being installed at the back side of the image receiving member (7), wherein the width of the developer layer is narrower than the width of the maintaining member (32), viewed from a direction perpendicular to a moving direction of the image receiving member (7), and both ends of the developer layer are arranged inside from both ends of the maintaining member (32).

19. An image forming device comprising:

a developer carrier (1) for carrying a charged developer (2);

a developer passing controller (3) for controlling the passing of said developer (2) by applying a voltage corresponding to an image signal to a plurality of control electrodes (10), the developer passing controller having a plurality of developer passing holes (4) through which the developer (2) passes and said control electrodes being arranged to surround the surroundings of the developer passing holes;

a maintaining member (32) for maintaining a distance from a developer layer on said developer carrier (1) to said developer passing controller (3) constantly by contacting the developer layer on said developer carrier (1) and the developer passing controller (3);

an image receiving member (7) for receiving said developer (2) passed through; and a backside electrode (6) for drawing said developer (2), the backside electrode being installed at the back side of the image receiving member (7), wherein the width of the developer passing controller (3) is wider than the width of the maintaining member (32), viewed from a direction perpendicular to a moving direction of the image receiving member (7), and both ends of the developer passing controller (3) are arranged outside both ends of the maintaining member (32).

20. An image forming device comprising:

a developer carrier (1) for carrying a charged developer (2);

a developer passing controller (3) for controlling the passing of said developer (2) by applying a voltage corresponding to an image signal to a plurality of control electrodes (10), the developer passing controller having a plurality of developer passing holes (4) through which the developer (2) passes and said control electrodes being arranged to surround the surroundings of the developer passing holes;

a maintaining member (32) for maintaining a distance from a developer layer on said developer carrier (1) to said developer passing controller (3) constantly by contacting the developer layer on said developer carrier (1) and the developer passing controller (3);

an image receiving member (7) for receiving said developer (2) passed through; and a backside electrode (6) for drawing said developer (2), the backside electrode being installed at the back side of the image receiving member (7), wherein the width of said developer carrier (1) is wider than the width of the maintaining member (32), viewed from a direction perpendicular to a moving direction of said image receiving member (7), and both ends of said developer carrier (1) are arranged outside both ends of said maintaining member (32).

21. An image forming device comprising:

a developer carrier (1) for carrying a charged developer (2);

a developer passing controller (3) for controlling the passing of said developer (2) by applying a voltage corresponding to an image signal to a plurality of control electrodes (10), the developer passing controller having a plurality of developer passing holes (4) through which the developer (2) passes and said control electrodes being arranged he to surround the surroundings of the developer passing holes;

an image receiving member (7) for receiving said developer (2) passed through;

a backside electrode (6) for drawing said developer (2) with electromagnetic force, the backside electrode having an opening (33) and being installed at the back side of the image receiving member (7); and an airflow generating member (34) for drawing said developer (2) adhered to the developer passing controller (3) with airflow, wherein the width of the opening (33) is wider than the width of an electrode row (31) located in a region which is adjacent to the developer carrier (1) in said developer passing controller (3), viewed from a direction perpendicular to a moving direction of said image receiving member (7), and both ends of the opening (33) are arranged outside both ends of the electrode row (31).

22. An image forming device comprising:

a developer carrier (1) for carrying a charged developer (2);

a developer passing controller (3) for controlling the passing of said developer (2) by applying a voltage corresponding to an image signal to a plurality of control electrodes (10), the developer passing controller having a plurality of developer passing holes (4) through which the developer (2) passes and said control electrodes being arranged to surround the surroundings of the developer passing holes;

an image receiving member (35) for receiving said developer (2) passed through, the image receiving member (35) having a second opening (38);

a backside electrode (6) for drawing said developer (2) with electromagnetic force, the backside electrode having a first opening (33) and being installed at the back side of the image receiving member (35); and an airflow generating member (34) for drawing said developer (2) adhered to the developer passing controller (3) to the first opening (33) through the second opening (38) with airflow, wherein the width of said first opening (33) is wider than the width of said second opening (38), viewed from a direction perpendicular to a moving direction of said image receiving member (35), and both ends of said first opening (33) are arranged outside both ends of said second opening (38).

23. The image forming device according to any of claims 14, 15 and 21, wherein said electrode row (31) has a control electrode row where said control electrodes (10) are arranged, and an external electrode (30) for receiving a desired voltage and being arranged outside both ends of the control electrode row in the longitudinal direction.

24. The image forming device according to claim 16, wherein an insulating layer is provided in an area on the surface of said image receiving member (7) opposed to said developer passing controller (3), where both ends of said backside electrode (6) are located in the back.

25. The image forming device according to any of claims 19 and 20, wherein said maintaining member (32) is made of an insulating material.

* * * * *